United States Patent [19]

Takahashi et al.

[11] Patent Number: 4,762,773

[45] Date of Patent: Aug. 9, 1988

[54] SILVER HALIDE COLOR PHOTOGRAPHIC LIGHT-SENSITIVE MATERIAL CONTAINING A HYDROQUINONE DERIVATIVE AND A PYRAZOLOAZOLE COUPLER

[75] Inventors: Osamu Takahashi; Nobuo Sakai, both of Ashigara, Japan

[73] Assignee: Fuji Photo Film Co., Ltd., Kanagawa, Japan

[21] Appl. No.: 916,431

[22] Filed: Oct. 7, 1986

[30] Foreign Application Priority Data

Oct. 7, 1985 [JP] Japan ..... 60-223346

[51] Int. Cl.[4] ..... G03C 7/16

[52] U.S. Cl. ..... 430/380; 430/381; 430/382; 430/505; 430/548; 430/551; 430/558

[58] Field of Search ..... 430/558, 551, 548, 505, 430/372, 381, 382, 380

[56] References Cited

U.S. PATENT DOCUMENTS

| | | | |
|---|---|---|---|
| 3,806,347 | 4/1974 | Ohyama et al. | 430/505 |
| 4,614,707 | 9/1986 | Fujita et al. | 430/551 |
| 4,618,573 | 10/1986 | Okamura et al. | 430/558 |

*Primary Examiner*—Paul R. Michl
*Assistant Examiner*—Patrick A. Doody
*Attorney, Agent, or Firm*—Sughrue, Mion, Zinn, Macpeak and Seas

[57] ABSTRACT

A silver halide color photographic light-sensitive material comprising at least one silver halide light-sensitive emulsion layer associated with a magenta coupler provided on a support, wherein at least one of said silver halide emulsion layer and the layer(s) adjacent to the emulsion layer contains a hydroquinone derivative, wherein said coupler is at least one compound selected from the group consisting of compounds represented by formula (I), bis-compounds derived from the compounds, and polymers having coupler residues derived from the compounds, (I)

wherein $R_1$ represents a hydrogen atom or a substituent; X represents a hydrogen atom or group which can be released therefrom upon coupling with an oxidized form of an aromatic primary amine-developing agent; and Za, Zb, and Zc each represents a methine, substituted methine, =N—, or —NH—, one of Za-Zb bond and Zb-Zc bond is a double bond and the other is a single bond, and when the Zb-Zc bond is a carbon-carbon double bond, it can form a part of an aromatic ring, or $R_1$ or X is a group forming the bis-compound or the polymer or Za, Zb, or Zc represents a substituted methine forming the bis-compound or the polymer, and said hydroquinone derivative is represented by formula (II)

(II)

wherein $R_2$ represents a substituted or unsubstituted alkyl group, alkoxy group, aromatic group, or alkylthio group; $R_3$ represents an alkylene group; n represents an integer of 0 or 1; and $M^{\oplus}$ represents a cation.

50 Claims, No Drawings

SILVER HALIDE COLOR PHOTOGRAPHIC LIGHT-SENSITIVE MATERIAL CONTAINING A HYDROQUINONE DERIVATIVE AND A PYRAZOLOAZOLE COUPLER

FIELD OF THE INVENTION

The present invention relates to a silver halide color photographic light-sensitive material. More particularly, the present invention relates to a silver halide color photographic light-sensitive material, in which there is less dependency by magenta color density on the concentration of sulfite present in the developing agent, providing an improved color reproducibility.

BACKGROUND OF THE INVENTION

In a silver halide color photographic light-sensitive material, a process using a dye-forming coupler which reacts with an oxidized form of an aromatic primary amine-developing agent to form a dye (hereinafter referred to as "coupler") is often applied. In particular, combinations of yellow coupler, cyan coupler, and magenta coupler are generally used for such a color light-sensitive material.

5-pyrazolone couplers are often used as magenta couplers. However, such a 5-pyrazolone coupler is disadvantageous in color reproduction in that it has a side absorption, in the proximity of 430 nm, and that the tail of the longer wavelength side of the absorption curve is not sharp.

As magenta couplers which eliminate these defects, pyrazoloazole couplers have been known as described in Japanese Patent Application (OPI) Nos. 171956/84, 33552/85, and 43659/85 (the term "OPI" as used herein means an "unexamined published application"), and U.S. Pat. Nos. 4,500,630 and 4,540,654.

It is useful to incorporate a sulfite (e.g., sodium sulfite) in the color-developing solution as a preservative. However, if such a pyrazoloazole coupler is used therewith, the dependency of change of color density or gradation on the change of the concentration of sulfite in the developing solution (hereinafter referred to as "dependency of magenta density on sulfite concentration") becomes greater as compared to the conventional 5-pyrazolone coupler. As a result, if the concentration of sulfite in the developing solution changes, the color balance, color reproducibility, or the like changes, deteriorating the image quality. On the other hand, it has been confirmed in processing laboratories that the sulfite concentration varies over a wide range from a fraction to several times the so-called prescribed value. This is believed to be attributable to consumption of sulfite due to oxidation by air or development or excess supplement of sulfite.

SUMMARY OF THE INVENTION

It is therefore an object of the invention to provide a silver halide color photographic material which has a less dependency of magenta color density on the concentration of sulfite in the developing solution and thus provides an improved color reproducibility in a system using a pyrazoloazole coupler.

The above and other objects of the present invention will become more apparent from the following detailed description and examples.

These objects of the present invention can be accomplished by a silver halide color photographic light-sensitive material comprising at least one silver halide light-sensitive emulsion layer associated with a magenta coupler provided on a support, wherein at least one of said silver halide emulsion layer and the layer(s) adjacent to the emulsion layer contains a hydroquinone derivative, wherein said coupler is at least one compound selected from the group consisting of compounds represented by formula (I), bis-compounds derived from the compounds, and polymers having coupler residues derived from the compounds,

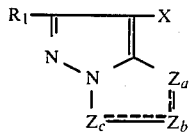

(I)

wherein $R_1$ represents a hydrogen atom or a substituent; X represents a hydrogen atom or group which can be released therefrom upon coupling with an oxidized form of an aromatic primary amine-developing agent; and Za, Zb, and Zc each represent a methine, substituted methine, =N—, or —NH—, one of Za-Zb bond and Zb-Zc bond is a double bond and the other is a single bond, and when the Zb-Zc bond is a carbon-carbon double bond, it can form a part of an aromatic ring, or $R_1$ or X is a group forming the bis-compound or the polymer, or Za, Zb, or Zc, represents a substituted methine, forming the bis-compound or the polymer, and said hydroquinone derivative is represented by formula (II)

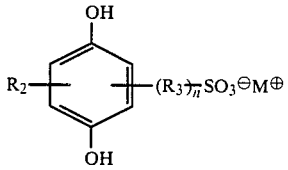

(II)

wherein $R_2$ represents a substituted or unsubstituted alkyl group, alkoxy group, aromatic group, or alkylthio group; $R_3$ represents an alkylene group; n represents an integer of 0 or 1; and $M^{\oplus}$ represents a cation.

DETAILED DESCRIPTION OF THE INVENTION

The magenta couplers of formula (I) and the hydroquinone derivatives of formula (II) which are used in the present invention will be described in detail hereinafter.

In formula (I), the substituent is preferably, for example, halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycabonylamino group, aryloxycarbonylamino group, sulfonamide group, carbamoyl group, acyl group, sulfamoyl group, sulfonyl group, sulfinyl group, alkoxycarbonyl group, aryloxycarbonyl group, or substituted groups thereof.

In formula (II), when $R_2$ is a substituted or unsubstituted alkyl group, it may be a straight chain, branched chain or cyclic group. Examples of the substituent include a hydroxy group, halogen atom, $—SO_3M$, —COOM (wherein M represents H, an alkali metal atom such as Li, Na, and K, an alkaline earth metal atom such as Ca and Mg, and $NH_4$), amino group, alkyloxy group, alkylthio group, aryloxy group, arylthio group, sulfonamide group, alkylamide group, and aldehyde group. Specifc examples of the alkyl group represented by $R_2$ include a methyl group, ethyl group, methoxyethyl group, n-propyl group, iso-propyl group, allyl group, n-butyl group, t-butyl group, iso-butyl group, t-amyl group, n-octyl group, t-octyl group, t-pentadecyl group, n-hexadecyl group, and sec-octadecyl group.

If $R_2$ is a substituted or unsubstituted alkoxy group, the carbon chain may be a straight-chain or branched-chain. Examples of the substituent include an alkoxy group (particularly a methoxy group, ethoxy group, and butoxy group), phenyloxy group, halogen atom (particularly a chlorine atom), and amino group.

Specific examples of $R_2$ which is an aromatic group include phenyl group and substituted phenyl group. Examples of substituents for such a substituted phenyl group include an alkyl group (particularly a methyl group), alkoxy group (particularly methoxy group), and halogen atom (particularly chlorine atom).

When $R_2$ is a substituted or unsubstituted alkylthio group the carbon chain may be a straight chain or branched chain. Examples of a substituent include an alkoxy group (particularly a methoxy group).

$R_3$ is a straight-chain or branched alkylene group which preferably contains from 1 to 4 carbon atoms.

$M^{\oplus}$ represents a hydrogen ion, alkali metal ion such as $Li^{\oplus}$, $Na^{\oplus}$, and $K^{\oplus}$, alkaline earth metal ion such as $\frac{1}{2}Ca^{\oplus\oplus}$ and $\frac{1}{2}Mg^{\oplus\oplus}$, ammonium ion, etc.

In formula (II), preferably n is 0, and the total number of carbon atoms constituting $R_2$ is preferably 6 or more, more preferably when the total number of carbon atoms is 10 or more and most preferably 15 or more. The carbon number is preferably not more than 30, so long as the compound of formula (II) is substantially non-diffusible in a hydrophilic colloid layer. It is preferable that n and the carbon number satisfy these preferable conditions at the same time.

The added amount of the compound of formula (II) which is used in the present invention is generally from 0.1 to 50 mol%, and preferably from 1 to 20 mol% of the magenta coupler of the present invention.

The compound of formula (II) may be prepared, e.g., in accordance with the synthesis of sulfonic acid-substituted hydroquinone derivatives as described in Japanese Patent Application (OPI) No. 61287/84 and British Pat. No. 1,156,167.

The addition of the hydroquinone derivative of formula (II) to the photographic emulsion can be accomplished by dissolving the hydroquinone derivative in a water-miscible organic solvent such as methanol, ethanol, tetrahydrofuran, and acetone or a mixture thereof with water, adding the resulting solution to an aqueous solution of gelatin, and then adding the gelatin solution to the photographic emulsion. Alternatively, the solution of the hydroquinone derivative in the water-miscible organic solvent or a mixture thereof with water may be directly added to the photographic emulsion.

Examples of compound of formula (II)

(1)

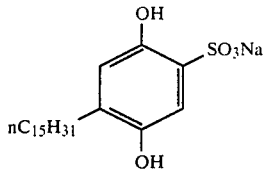

(2)

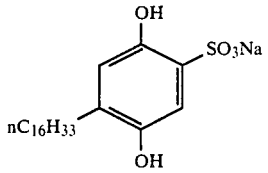

(3)

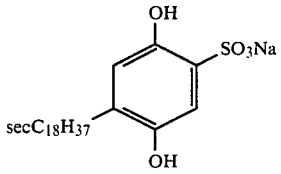

(4)

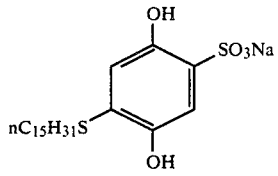

(5)

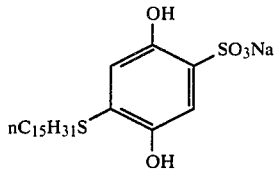

(6)

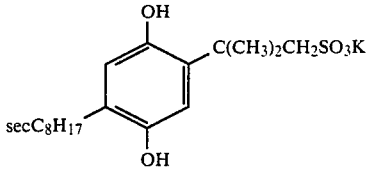

In the definition of formula (I), the term "bis-compound" and "polymer" means a coupler containing two or more coupler residue derived from the compound represented by formula (I) in one molecule. The polymer coupler may be a homopolymer or copolymer made up of one or more of monomers having a residue derived from the compound represented by formula (I) (the monomer preferably has a group having an ethylenic unsaturated double bond; hereinafter referred to as "vinyl monomer") or one or more of the monomers may form a copolymer together with a colorless ethylenic monomer which does not undergo a coupling reaction with an oxidized form of an aromatic primary amine developing agent.

Preferred couplers among pyrazoloazole magenta couplers of formula (I) (including the bis-compound and the polymer) are those represented by formulae (III), (IV), (V), (VI), (VII), (VIII), and (IX).

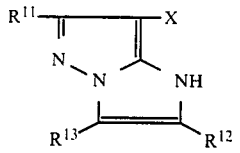
(III)

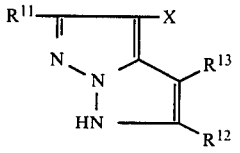
(IV)

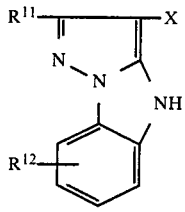
(V)

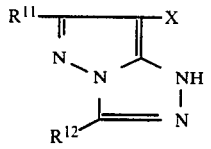
(VI)

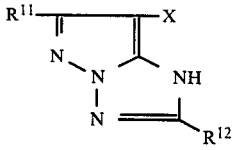
(VII)

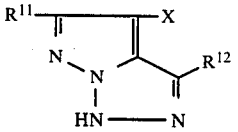
(VIII)

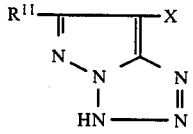
(IX)

Among the couplers represented by formulae (III) through (IX), those represented by formulae (III), (VI), and (VII) are particularly suitable for the objects of the present invention. Especially preferred among these couplers is that represented by formula (VII).

In formulae (III) through (IX), $R^{11}$, $R^{12}$, and $R^{13}$ may be the same or different from each other, and each represents a hydrogen atom, halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycabonylamino group, aryloxycarbonylamino group, sulfonamido group, carbamoyl group, acyl group, sulfamoyl group, sulfonyl group, sulfinyl group, alkoxycarbonyl group, or aryloxycarbonyl group. X has the same meanings as that in formula (I). Examples of X include a hydrogen atom, halogen atom, carboxy group, or a coupling-off group which can be bonded to the coupling-position carbon atom via an oxygen, nitrogen, or sulfur atom. The above-described groups (having a hydrogen atom) may be substituted. $R^{11}$, $R^{12}$, $R^{13}$, or X may be a divalent group and thus form a bis-compound.

The above-described heterocyclic group or heterocyclic residue is preferably a 5- or 6-membered heterocyclic group containing at least one of N, O, and S atoms.

The polymer coupler containing a coupler residue derived from the coupler represented by any one of formulae (III) through (IX) present at the main chain or side chain thereof may also be used. Particularly, a polymer derived from a vinyl monomer containing a portion represented by the formulae is preferably used. In this case, $R^{11}$, $R^{12}$, $R^{13}$, or X represents a group having an ethylenic unsaturated group or linkage group.

More particularly, $R^{11}$, $R^{12}$, and $R^{13}$ each represents a hydrogen atom, a halogen atom (e.g., chlorine atom and bromine atom), an alkyl group (e.g., methyl group, propyl group, isopropyl group, t-butyl group, trifluoromethyl group, tridecyl group, 2-{α-[3-(2-octyloxy-5-tert-octylbenzenesulfonamido)phenoxy]tetradecaneamide}ethyl group, 3-(2,4-di-t-amylphenoxy)-propyl group, allyl group, 2-dodecyloxyethyl group, 1-(2-octyloxy-5-tert-octylbenzenesulfonamido)-2-propyl group, 1-ethyl-1-[4-2-butoxy-5-tert-octylbenzenesulfonamido)phenyl]methyl group, 3-phenoxypropyl group, 2-hexylsulfonyl ethyl group, cyclopentyl group, and benzyl group), an aryl group (e.g., phenyl group, 4-t-butylphenyl group, 2-4-di-t-amylphenyl group, and 4-tetradecaneamide phenyl group), a heterocyclic group (e.g., 2-furyl group, 2-thienyl group, 2-pyrimidinyl group, and 2-benzothiazolyl group), a cyano group, an alkoxy group (e.g., methoxy group, ethoxy group, 2-methoxyethoxy group, 2-dodecyloxyethoxy group, and 2-methanesulfonylethoxy group), an aryloxy group (e.g., phenoxy group, 2-methylphenoxy group, and 4-t-butylphenoxy group), a heterocyclic oxy group (e.g., 2-benzimidazolyloxy group), an acyloxy group (e.g., acetoxy group and hexadecanoyloxy group), a carbamoyloxy group (e.g., N-phenylcarbamoyloxy group and N-ethylcarbamoyloxy group), a silyloxy group (e.g., trimethylsilyloxy group), a sulfonyloxy group (e.g., dodecylsulfonyloxy group), an acylamino group (e.g., acetomido group, benzamido group, tetradecaneamido group, α-(2,4-di-t-amylphenoxy)butylamido group, γ-(3-t-butyl-4-hydroxyphenoxy)butylamido group, and α-[4-(4-hydroxyphenylsulfonyl)phenoxy]decaneamido group), an anilino group (e.g., phenylamino group, 2-chloroanilino group, 2-chloro-5-tetradecaneamidoanilino group, 2-chloro-5-dodecyloxycarbonylanilino group, N-acetylanilino group, and 2-chloro-5-[α-3-t-butyl-4-hydroxyphenoxy)dodecaneamido]anilino group), a ureido group (e.g., phenylureido group, methylureido group, and N,N-dibutylureido group, an imido group (e.g., N-succinimido group, 3-benzylhydantoinyl group, and 4-(2-ethylhexanoylamino)phthalimido group, a sulfamoylamino group (e.g., N,N-dipropyl sulfamoylamino group and N-methyldecylslfamoylamino group,), an alkylthio group (e.g., methylthio group, octylthio group, tetradecylthio group, 2-phenoxyethylthio group, 3-phenoxypropylthio group, and 3-(4-t-butylphenoxy)propylthio group), an arylthio group (e.g., phenylthio group, 2-butoxy-5-t-octylphenylthio group, 3-pentadecylphenylthio group, 2-carboxy phenylthio group, and 4-tetradecaneamidophenylthio group), a heterocyclic thio group (e.g., 2-benzothiazolylthio group), an alkoxycarbonylamino group (e.g., methoxycarbonylamino group, and tetradecyloxycarbonylamino group), an aryloxycarbonylamino group (e.g., phenoxycarbonylamino group and 2,4-di-tert-butylphenoxycarbonylamino group), a sulfonamido group (e.g., methanesulfonamido group, hexadecanesulfonamido group, benzenesulfonamido group, p-toluene sulfonamido group, octadecanesulfonamido group, and 2-methyloxy-5-t-butylbenzenesulfonamido group), a carbamoyl group (e.g., N-ethylcarbamoyl group, N,N-dibutylcarbamoyl group, N-(2-dodecyloxyethyl)carbamoyl group, N-methyl-N-dodecylcarbamoyl group, and N-[3-(2,4-di-tert-amylphenoxy)propyl]carbamoyl group), an acyl group (e.g., acetyl group, (2,4-di-tert-amylphenoxy)acetyl group, and benzoyl group), a sulfamoyl group (e.g., N-ethylsulfamoyl group, N,N-dipropylsulfamoyl group, N-(2-dodecyloxyethyl)sulfamoyl group, N-ethyl-N-dodecylsulfamoyl group, and N,N-diethylsulfamoyl group), a sulfonyl group (e.g., methanesulfonyl group, octanesulfonyl group, benzenesulfonyl group, and toluenesulfonyl group), a sulfinyl group (e.g., octanesulfinyl group, dodecylsulfinyl group, and phenylsulfinyl group), an alkoxycarbonyl group (e.g., methoxycarbonyl group, butyloxycarbonyl group, dodecyloxycarbonyl group, and octadecyloxycarbonyl group), or an aryloxycarbonyl group (e.g., phenyloxycarbonyl group, and 3-pentadecylphenyloxy carbonyl group). X represents a hydrogen atom, halogen atom (e.g., chlorine atom, bromide atom, and iodine atom), —COOM (M is defined as hereinabove), a group containing an oxygen linkage (e.g., acetoxy group, propanoyloxy group, benzoyloxy group, 2,4-dichlorobenzoyloxy group, ethoxyxaloyloxy group, pyruvinyloxy group, cinnamoyloxy group, phenoxy group, 4-cyanophenoxy group, 4-methanesulfonamido phenoxy group, 4-methanesulfonyl phenoxy group, α-naphthoxy group, 3-pentadecyl phenoxy group, benzyloxy carbonyloxy group, ethyoxy group, 2-cyanoethoxy group, benzyloxy group, 2-phenethyloxy group, 2-phenoxyethoxy group, 5-phenyltetrazolyloxy group, and 2-benzothiazolyloxo group), a group containing a nitrogen linkage (e.g., benzenesulfonamido group, N-ethyltoluenesulfonamido group, heptafluorobutaneamido group, 2,3,4,5,6-pentafluorobenzamido group, octanesulfonamido group, p-cyanophenylureido group, N,N-diethylsulfamoylamino group, 1-piperidyl group, 5,5-dimethyl-2,4-dioxo-3-oxazolydinyl group, 1-benzyl-ethoxy-3-hydantoinyl group, 2N-1,1-dioxo-3-(2H)-oxo-1,2-benzoisothiazolyl group, 2-oxo-1,2-dihydro-1-pyridinyl group, imidazolyl group, pyrazolyl group, 3,5-diethyl-1,2,4-triazole-1-yl, 5- or 6-bromo-benzotriazole-1-yl, 5-methyl-1,2,3,4-triazole-1-yl group, benzimidazolyl group, 3-benzyl-1-hydantoinyl group, 1-benzyl-5-hexadecyloxy-3-hydantoinyl group, and 5-methyl-1-tetrazolyl group, arylazo group such as 4-methoxyphenylazo group, 4-pivaloylaminophenylazo group, 2-naphthylazo group, and 3-methyl-4-hydroxyphenylazo group), or a group containing a sulfur linkage (e.g., phenylthio group, 2-carboxyphenylthio group, 2-methoxy-5-t-octylphenylthio group, 4-methanesulfonylphenylthio group, 4-octanesulfonamidophenylthio group, 2-butoxyphenylthio group, 2-(2-hexanesulfonylethyl)-5-tert-octylphenylthio group, benzylthio group, 2-cyanoethylthio group, 1-ethoxycarbonyltridecylthio group, 5-phenyl-2,3,4,5-tetrazolylthio group, 2-benzothiazolythio group, 2-dodecylthio-5-thiophenylthio group, and 2-phenyl-3-dodecyl-1,2,4-triazole-5-thio group.

In the couplers represented by formulae (III) and (IV), $R^{12}$ and $R^{13}$ may be bonded to each other to form a 5-, 6-, or 7-membered ring. $R^{12}$ and $R^{13}$ may form a saturated or unsaturated hydrocarbon ring (including a benzene ring in the case of formula (IV)).

When $R^{11}$, $R^{12}$, $R^{13}$, or X is a divalent group it forms a linking group which links two pyrazoloazole rings to form a bis-compound. The linking group derived from $R^{11}$, $R^{12}$, and $R^{13}$ preferably is a substituted or unsubstituted alkylene group or a substituted or unsubstituted group having at least two alkylene groups linked with each other by an oxygen atom to form a divalent group, such as a methylene group, ethylene group, 1,10-decylene group, and $—CH_2CH_2—O—CH_2CH_2—$ group, substituted or unsubstituted phenylene group (e.g., 1,4-phenylene group, 1,3-phenylene group,

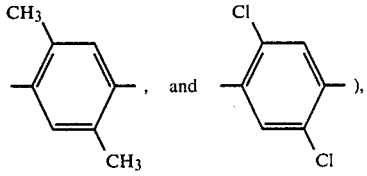

—NHCO—$R^{14}$—CONH— group (wherein $R^{14}$ represents a substituted or unsubstituted alkylene or phenylene group), for example, $—NHCOCH_2CH_2CONH—$,

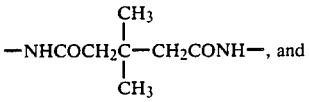

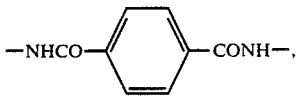

or —S—$R^{15}$—S— group (wherein $R^{15}$ represents a substituted or unsubstituted alkylene group), for example, $—S—CH_2CH_2—S$ and

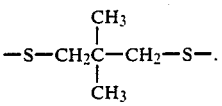

X represents a group obtained by converting the above-mentioned monovalent group to a divalent group at a proper position.

When the compounds of formulae (III), (IV), (V), (VI), (VII), (VIII), and (IX) are vinyl monomers, the ethylenic unsaturated groups represented by $R^{11}$, $R^{12}$, $R^{13}$, or X may have a linkage (linking to the nucleus) group selected from a substituted or unsubstituted alkylene group or a substituted or unsubstituted group having at least two alkylene groups linked with each other by an oxygen atom to form a divalent group (e.g., methylene group, ethylene group, 1,10-decylene group, and $—CH_2CH_2OCH_2CH_2—$), substituted or unsubstituted phenylene groups (e.g., 1,4-phenylene group, 1,3-phenylene group,

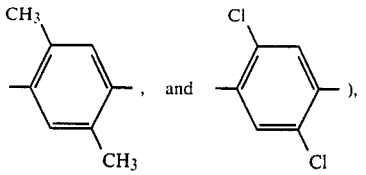

—NHCO—, —CONH—, —O—, —OCO— and substituted or unsubstituted aralkylene groups (e.g.,

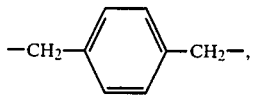

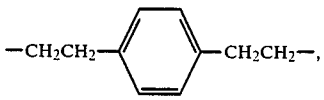

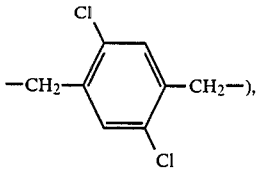

and groups formed by combination of two or more of these groups.

Preferred examples of such a linkage group include —NHCO—, —$CH_2CH_2$—,

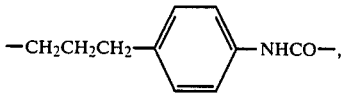

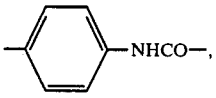

—$CH_2CH_2NHCO$—,

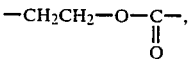

—CONH—$CH_2CH_2NHCO$—, —$CH_2CH_2O$—$CH_2CH_2$—NCHO—, and

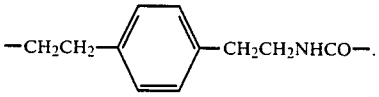

The above-mentioned vinyl groups may contain substituents other than those represented by formulae (III), (IV), (V), (VI), (VII), (VIII), and (IX). Preferred substituents include a chlorine atom, and a lower alkyl group having from 1 to 4 carbon atoms (e.g., methyl group and ethyl group).

The monomers derived from the compounds of formula (III), (IV), (V), (VI), (VII), (VIII), or (IX) may form a copolymer together with colorless ethylenic monomers which do not undergo coupling reaction with an oxidized product of an aromatic primary amine-developing agent.

Examples of such colorless ethylenic monomers which do not undergo coupling reaction with an oxidized product of an aromatic primary amine-developing agent include acrylic acid, α-chloroacrylic acid, an α-alkylacrylic acid (e.g., methacrylic acid), and an ester and amide derived from these acrylic acids (e.g., acrylamide, n-butylacrylamide, t-butylacrylamide, diacetonacrylamide, methacylamide, methylacrylate, ethylacrylate, n-propylacrylate, n-butylacrylate, t-butylacrylate, iso-butylacrylate, 2-ethylhexylacrylate, n-octylacrylate, lauryacrylate, methylmethacrylate, ethylmethacrylate, n-butylmethacrylate, and β-hydroxymethacrylate), methylene dibisacrylamide, a vinylester (e.g., vinyl acetate, vinyl propionate, and vinyl laurate), acrylonitrile, methacrylonitrile, an aromatic vinyl compound (e.g., styrene and derivatives thereof, vinyl toluene, divinyl benzene, vinyl acetophenone, and sulfostyrene), itaconic acid, citraconic acid, crotonic acid, vinylidene chloride, a vinyl alkyl ether (e.g., vinyl ethyl ether), maleic acid, maleic anhydride, maleic acid ester, N-vinyl-2-pyrrolidone, N-vinylpyridine, and 2- and 4-vinylpyridine. These colorless ethylenic unsaturated monomers may be used in combination. Examples of the combination include a combination of n-butylacrylate and methylacrylate, styrene and methacrylic acid, methacrylic acid and acrylamide, and methylacrylate and diacetonacrylamide.

As is well known in the field of polymer color couplers, the colorless ethylenic unsaturated monomer to be copolymerized with a solid water-insoluble monomer coupler may be selected properly so that the resulting copolymer can be favorably affected in its physical properties and/or chemical properties, such as solubility, compatibility with a binder for photographic colloidal composition such as gelatin, flexibility, and thermal stability.

Polymeric couplers that can be used in the present invention may be either water-soluble or water-insoluble. In particular, polymeric coupler latex are preferably used.

Specific examples of pyrazoloazole magenta couplers of formula (I) to be used in the present invention and their synthesis are described in Japanese Patent Application (OPI) Nos. 162548/84, 43659/85, 171956/84, 33552/85, 172982/85, and U.S. Pat. No. 3,061,432.

Specific examples of typical magenta couplers of the present invention and vinyl monomers thereof will be described hereinafter, but the present invention should not be construed as being limited thereto.

M-1
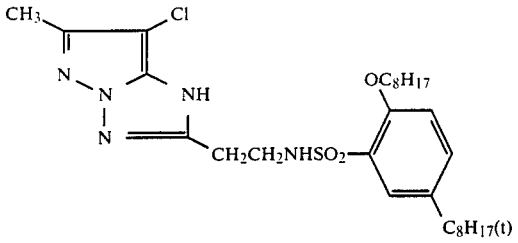
M-2
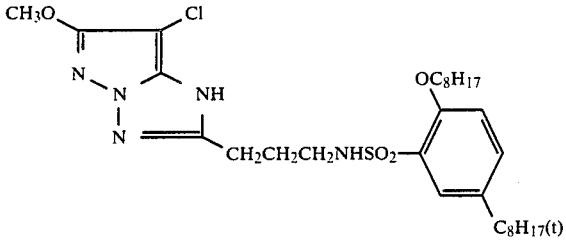
M-3
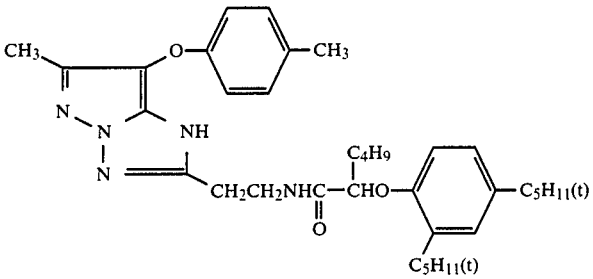
M-4
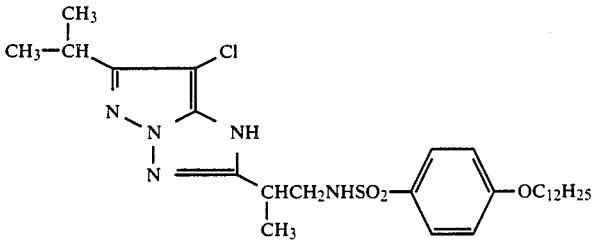
M-5
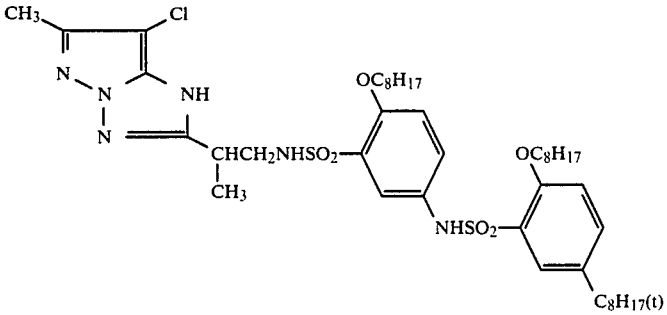
M-6
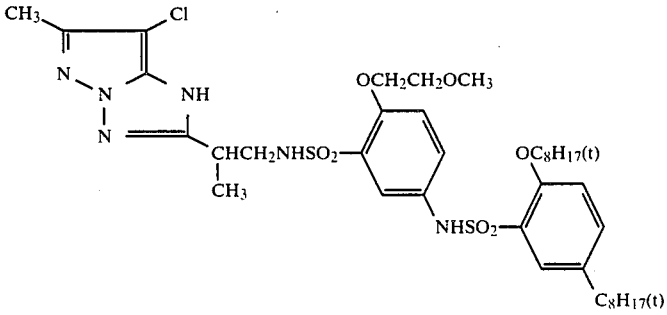

-continued
M-7
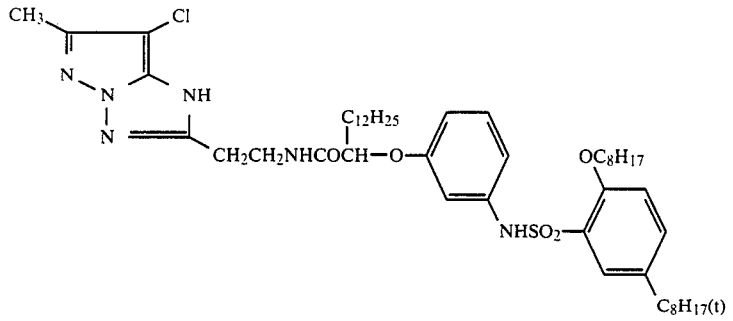
M-8
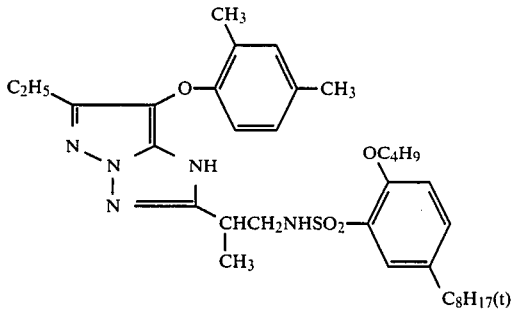
M-9
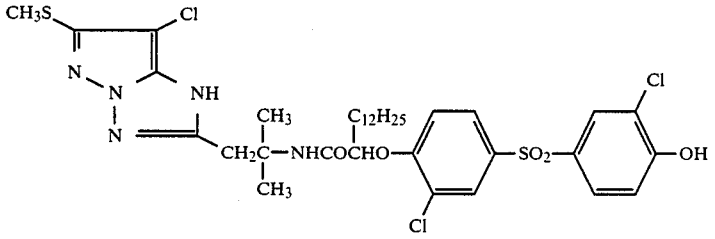
M-10
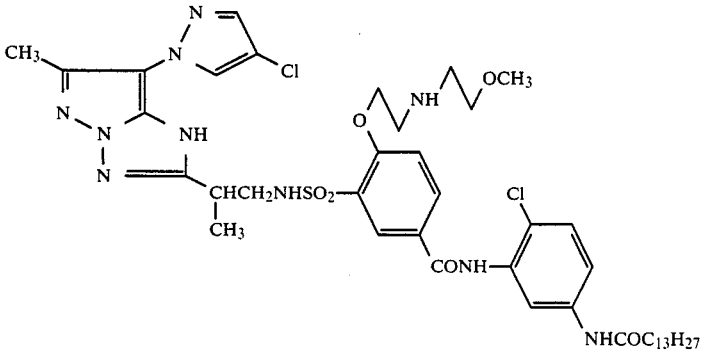
M-11
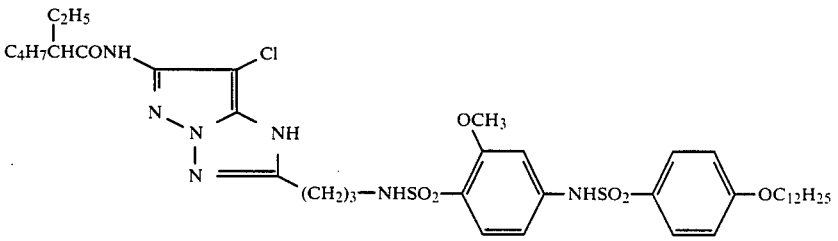

-continued
M-12
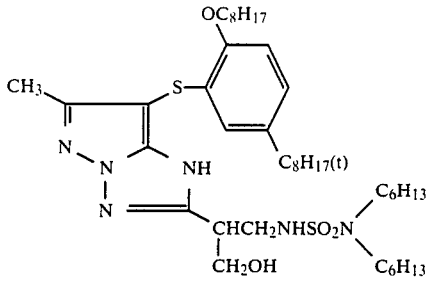
M-13
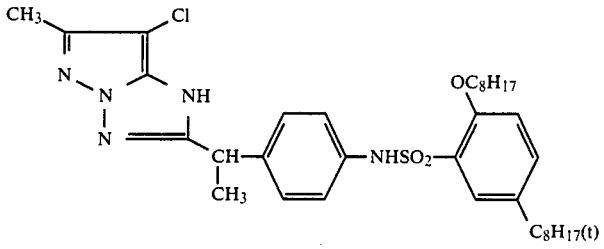
M-14
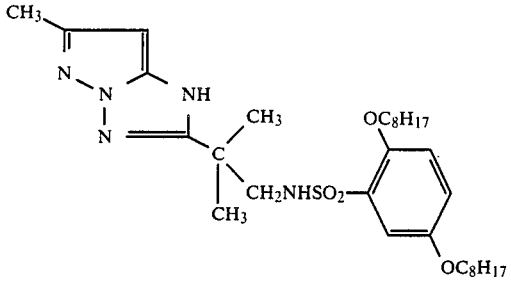
M-15
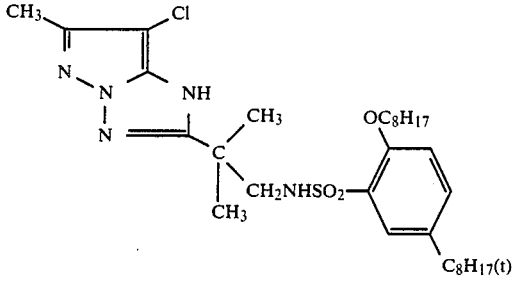
M-16
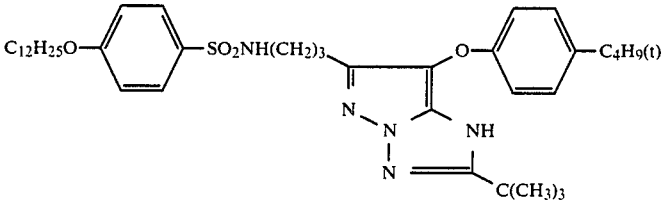
M-17
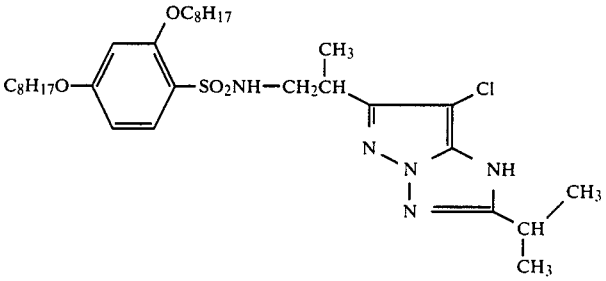

-continued
M-18
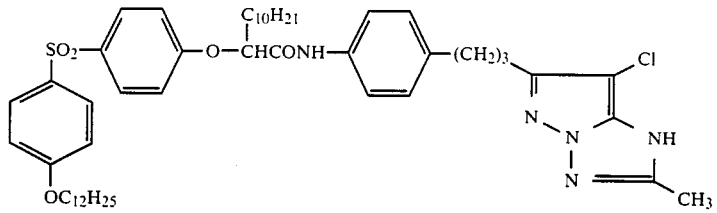
M-19
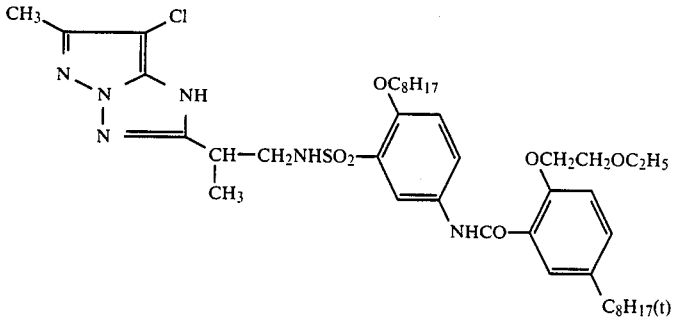
M-20
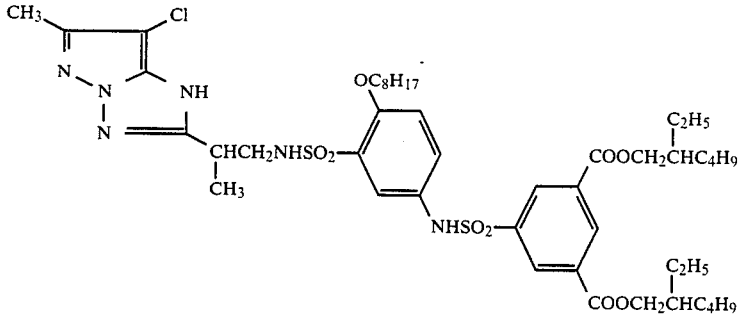
M-21
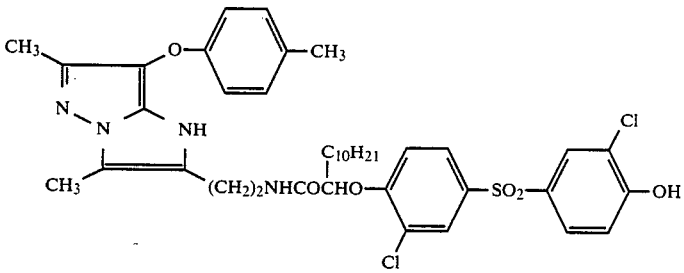
M-22
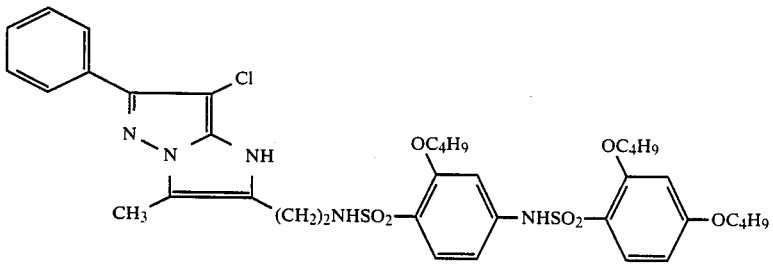
M-23
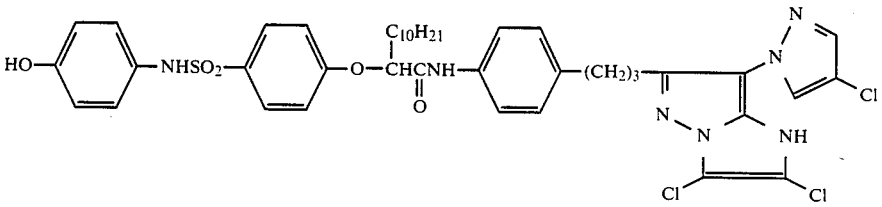

-continued
M-24
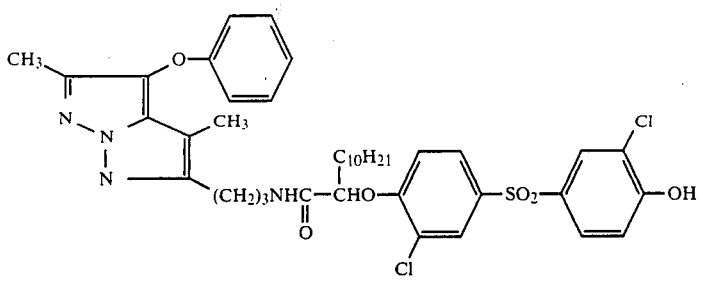
M-25
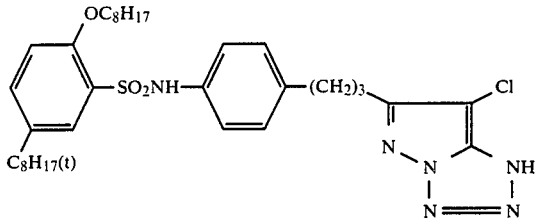
M-26
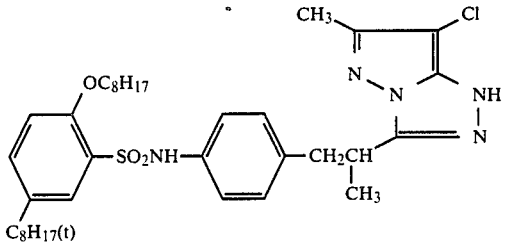
M-27
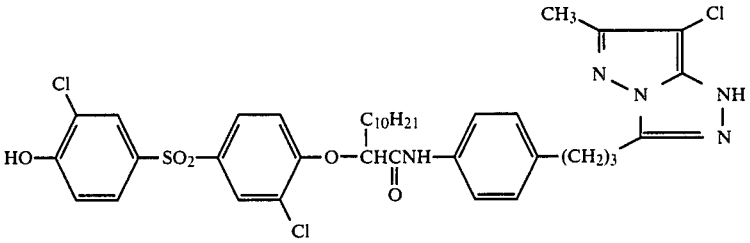
M-28
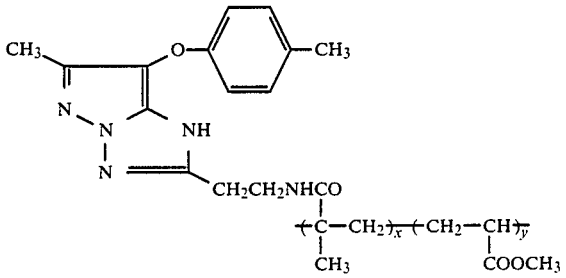
x:y = 50:50
(by weight)
M-29
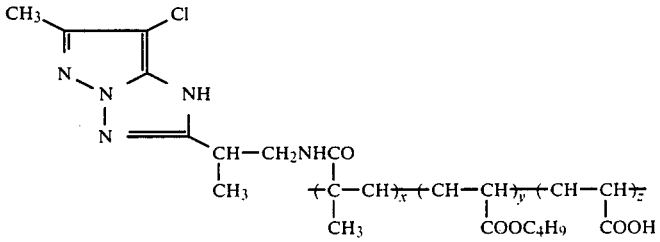
x:y:z = 50:40:10
(by weight)

-continued

M-30

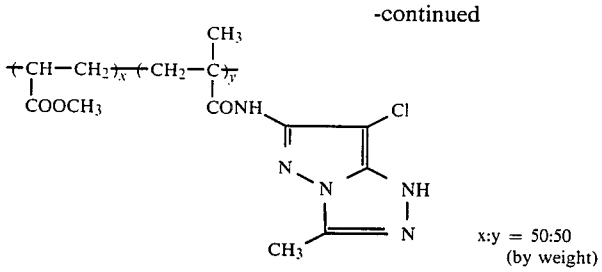

x:y = 50:50 (by weight)

M-31

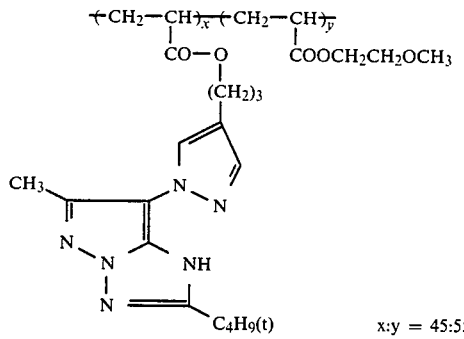

x:y = 45:55 (by weight)

At least one of the couplers represented by formula (I) of the present invention is added to the emulsion layer and/or to a layer(s) adjacent thereto in an amount of from $1\times10^{-3}$ mol to 1 mol, and preferably from $5\times10^{-2}$ mol to $5\times10^{-1}$ mol per mol of silver halide present in the silver halide emulsion layer. It is preferable to add the coupler(s) to the silver halide emulsion layer.

In the present invention, cyan and yellow couplers may be used besides the previously mentioned magenta couplers.

Typical examples of such cyan and yellow couplers include naphthol or phenol compounds and open-chain or heterocyclic ketomethylene compounds. Specific examples of these cyan and yellow couplers which may be used in the present invention are described in the patents cited in Article VII-D of *Research Disclosure,* RD No. 17643 (December 1978) and Ibid., RD No. 18717 (November 1979).

The color coupler to be incorporated in the light-sensitive material is preferably rendered diffusion-resistant by containing ballast groups or by being polymerized. The amount of silver to be coated can be reduced by using a two-equivalent color coupler substituted by a coupling-off group rather than a four-equivalent color coupler containing a hydrogen atom at the coupling active position. A coupler containing a color-forming dye having a proper diffusibility, colorless coupler, DIR coupler which releases a development inhibitor upon coupling reaction, or a development accelerator may be used.

Typical examples of yellow couplers which may be used in the present invention include oil protect type acylacetamide couplers. Specific examples of these couplers are described in U.S. Pat. Nos. 2,407,210, 2,875,057, and 3,265,506. In the present invention, two-equivalent yellow couplers are preferably used. Typical examples of such a two-equivalent yellow coupler include oxygen atom-releasing yellow couplers as described in U.S. Pat. Nos. 3,408,194, 3,447,928, 3,933,501, and 4,022,620 and nitrogen atom-releasing yellow couplers as described in Japanese Patent Publication No. 10739/83, U.S. Pat. Nos. 4,401,752 and 4,326,024, *Research Disclosure,* RD No. 18053 (April 1979), British Pat. No. 1,425,020, West German Patent Application (OLS) Nos. 2,219,917, 2,261,361, 2,329,587, and 2,433,812. α-pivaloylacetanilide couplers are excellent in fastness of dye formed, particularly to light. On the other hand, α-benzoyl acetanilide couplers can provide a high color density.

As cyan couplers which can be used in the present invention there are oil protect type naphthol and phenol couplers. Typical examples of such couplers are naphthol couplers as described in U.S. Pat. No. 2,474,293, preferably oxygen atom-releasing two-equivalent naphthol couplers as described in U.S. Pat. Nos. 4,052,212, 4,146,396, 4,228,233, 4,296,200. Specific examples of such a phenol coupler are described in U.S. Pat. Nos. 2,369,929, 2,801,171, 2,772,162, and 2,895,826. Cyan couplers fast to heat and moisture are preferably used. Typical examples of such cyan couplers include phenol cyan couplers containing an ethyl group or higher alkyl group at the meta-position of the phenol nucleus as described in U.S. Pat. No. 3,772,002, 2,5-diacylamino-substituted phenol couplers as described in U.S. Pat. Nos. 2,772,162, 3,758,308, 4,126,396, 4,334,011, and 4,327,173, West German Patent Application (OLS) No. 3,329,729 and Japanese Patent Application (OPI) No. 166,956/84, and phenol couplers containing a phenyl ureido group at the 2-position and an acylamino group at the 5-position as described in U.S. Pat. Nos. 3,446,622, 4,333,999, 4,451,559, and 4,427,767.

In order to meet the properties required by the light-sensitive material, two or more couplers of the present invention may be used in the same layer in combination. Alternatively, the same coupler may be incorporated in two or more layers.

The incorporation of the present couplers into the light-sensitive material may be accomplished by any suitable known dispersion process such as a solid dispersion process, alkali dispersion process, latex dispersion process, and oil-in-water dispersion process.

Preferred among them is a latex dispersion process, and particularly preferred among them is oil-in-water dispersion process. In the oil-in-water dispersion process, the present coupler is dissolved in either a high-boiling point organic solvent having a b.p. of 175° C. or more, or a low-boiling point solvent (i.e., auxiliary solvent), or a mixture thereof. The solution thus obtained is then finely dispersed in water or an aqueous medium such as aqueous solution of gelatin in the presence of a surface active agent. Examples of such high-boiling point organic solvents are described in U.S. Pat. No. 2,322,027.

A typical standard amount of the color coupler to be used is from 0.001 to 1 mol. Preferably the amount is from 0.01 to 0.5 mol, and from 0.002 to 0.3 mol, per mol of light-sensitive silver halide, respectively, for yellow coupler and cyan coupler.

In general, the silver halide emulsion to be used in the present invention is prepared by mixing a solution of a water-soluble halogen salt such as potassium bromide, sodium chloride, potassium iodide, and mixture thereof) in the presence of a solution of a water-soluble high molecular weight compound such as gelatin.

The particulate silver halide may have a construction such that the core and the surface layer thereof are different from each other or constitute a multi-phase construction having a junction. Alternatively, the particulate silver halide may have a construction such that the entire particle consists of a uniform phase. Furthermore, these constructions may be present in admixture. Referring to particulate silver chlorobromide having different phases, for example, the particle may contain inside a nucleus, or a single layer or a plurality of layers richer in silver bromide or silver chloride than the average halogen composition.

The average particle size (which is the average diameter of particles when the particles are spherical or nearly spherical, and which is the average edge length of particles determined based on a projection area when the particles are cubic) of the particle silver halide is preferably 2 μm or less and 0.1 μm or more, more preferably 1 μm or less and 0.15 μm or more. The distribution of particle size may be either narrow or wide.

So-called monodisperse silver halide emulsions may be used in the present invention. The degree of monodispersion is such that the coefficient of variation obtained by dividing the standard deviation derived from the size distribution curve of the silver halide by the average particle size is preferably 15% or less, more preferable 10% or less. In order to satisfy the gradation required by the light-sensitive material, two or more monodisperse silver halide emulsions having different particle sizes may be applied to the same layer in admixture or to different layers separately in an emulsion layer having substantially the same color sensitivity. Alternatively, two or more polydisperse silver halide emulsions or a combination of a monodisperse emulsion and a polydisperse emulsion may be used in admixture or in superimposed layers. The particulate silver halide to be used in the present invention may be in the form of a regular particle having a regular crystal form such as cube, octahedron, and tetradecahedron, in the form of a particle having an irregular crystal form such as a sphere, or in the form of composite thereof. Alternatively, the silver halide may be in the form of a tabular particle. In particular, an emulsion in which tabular particles having the ratio of length to thickness of 5 or more, particularly 8 or more, account for 50% or more of the total projected area of the particles may be used. An emulsion having a mixture of these various crystal forms may be used. These various emulsions may be of the surface latent image type which forms latent images mainly on the surface thereof or the internal latent image type which forms latent images inside the particles.

The photographic emulsion to be used in the present invention can be prepared by any suitable method as described in P. Glafkides, ed., *Chimie et Physique Photographique* (Paul Montel, 1967), G. F. Duffin, ed., *Photographic Emusion Chemistry* (Focal Press, 1966), and V. L. Zelikman et al, ed., *Making and Coating Photographic Emulsion* (Focal Press, 1964). That is, acidic process, neutral process, or ammonia process may be used. The reaction of the soluble silver salt with the soluble halogen salt may be accomplished by one-side mixing process, simultaneous mixing process, or combination thereof. A process in which particles are formed in excess silver ions (i.e., the so-called reverse mixing process) may be used. A conversion process in which a halogen salt forming a more insoluble silver halide is added may be used. As a form of simultaneous mixing process, the so-called controlled double jet process may be used in which the pAg·of the liquid phase in which silver halide is formed is maintained constant. This process can provide a silver halide emulsion having particles with a regular crystal form and nearly uniform particle size.

In the process of formation of particulate silver halide or in physical aging, cadmium salt, zinc salt, lead salt, thallium salt, iridium salt, or complex salt thereof, rhodium salt or complex salt thereof, or iron salt or complex salt thereof may be present.

In general, the silver halide emulsion is subjected to physical aging, desalting, and chemical aging after the formation of particles before being applied to the support.

In the process of precipitation, physical aging and chemical aging, any known silver halide solvent (e.g., ammonia, potassium thiocyanate, and a thioether and a thione as described in U.S. Pat. No. 3,271,157, Japanese Patent Application (OPI) Nos. 12360/76, 82408/78, 144319/78, 100717/79, and 155828/79) may be used. The removal of the soluble silver salt from the emulsion which has been subjected to physical aging can be accomplished by any suitable process such as noodle rinsing, flocculation sedimentation process, and ultrafiltration.

The photographic emulsion to be used in the present invention can be spectrally sensitized by a methine dye or the like if desired.

In order to prevent fogging in the preparation, preservation or photographic processing of the light-sensitive matrial or stabilize the photographic properties, the photographic emulsion to be used in the present inventon may comprise various compounds.

The light-sensitive material prepared in accordance with the present invention may contain as a color fog inhibitor or a color stain inhibitor a hydroquinone derivative, an aminophenol derivative, an amine, a gallic acid derivative, a catechol derivative, an ascorbic acid derivative, a colorless coupler, or a sulfonamide phenol derivative.

The present light-sensitive material may comprise various deterioration inhibitors.

In the present light-sensitive material, an ultraviolet absorber may be added to a hydrophobic colloidal layer.

The present light-sensitive material may comprise one or more surface active agents for various purposes such as facilitation of coating, antistatic effect, improvement of sliding, emulsion dispersion, prevention of adhesion, and improvement of photographic properties such as acceleration of development, contrast development and sensitization.

Besides the above-mentioned additives, various stabilizers, stain inhibitors, developing agents or their precursors, development accelerator or their precursors, lubricants, mordants, matting agents, antistatic agents, plasticizers, or other additives useful for photographic material may be added to the present light-sensitive material of the present invention. Typical examples of these additives are described in *Research Disclosure,* RD Nos. 17643 (December 1978) and 18716 (November 1979).

The present invention may be applied to a multilayer multicolor photographic material having at least two different spectral sensitivities on a support. A multilayer color photographic material generally has at least one red-sensitive emulsion layer, one green-sensitive emulsion layer, and one blue-sensitive emulsion layer on a support. The order of these layers can be properly selected as necessary. Each of these layers may comprise two or more emulsion layers having different sensitivities or two or more emulsion layers having the same sensitivity with a nonsensitive layer interposed therebetween.

Preferably, the light-sensitive material of the present invention comprises auxiliary layers such as protective layer, intermediate layer, filter layer, antihalation layer, and back layer besides the silver halide emulsion layer.

In the present photographic light-sensitive material, the photographic emulsion layer and other layers are applied to a flexible support such as plastic film, paper, and cloth which are commonly used, or a rigid support such as glass, ceramics, and metal.

As the support, baryta paper or a paper support laminated with a polyethylene containing a white pigment such as titanium oxide are preferably used.

The present invention can be applied to various light-sensitive materials. Typical examples of these light-sensitive materials include color negative films for general purpose and movies, color reversal films for slide projections and television, color papers, color positive films, and color reversal papers. The present invention can also be applied to a black-and-white light-sensitive material utilizing the mixing of three color coupler as described in *Research Disclosure,* RD No. 17123 (July 1978).

The color-developing solution to be used in the development of the present light-sensitive material is preferably an alkali aqueous solution mainly comprising an aromatic primary amine color-developing agent. As such a color-developing agent, a p-phenylene diamine compound is preferably used. Typical examples of such a compound include 3-methyl-4-amino-N,N-diethylaniline, 3-methyl-4-amino-N-ethyl-N-$\beta$-hydroxylethylaniline, 3-methyl-4-amino-N-ethyl-N-$\beta$-methanesulfonamide ethylaniline, 3-methyl-4-amino-N-ethyl-N-$\beta$-methoxyethylaniline, and sulfates, hydrochlorides, and p-toluenesulfonates thereof.

The color-developing solution generally contains a pH buffer such as a carbonate, borate, or phosphate of alkali metal, a development inhibitor or fog inhibitor such as bromide, iodide, benzimidazole, benzothiazole, and mercapto compound besides preservative such as sulfite of alkali metal and hydroxyl amine. The color-developing solution may also contain an organic solvent (e.g., benzyl alcohol and diethylene glycol), development accelerator such as polyethylene glycol, quaternary ammonium salt, an amine, or the like.

The photographic emulsion layer which has been subjected to color development is generally subjected to bleaching. Bleaching may be conducted simultaneously with, or separately from, fixing. As bleaching agent there may be used a compound of a polyvalent metal such as iron (III), cobalt (III), chromium (VI), and copper (II), a peroxide, a quinone, and nitroso compound. Typical examples of such a bleaching agent include ferricyanides, dichromates, organic complex salts of iron (III) or cobalt (III), aminopolycarboxylic acids such as ethylenediamine tetraacetic acid, diethylene triamine pentaacetic acid, nitrilo triacetic acid, 1,3-diamino-2-propanol tetraacetic acid; complex salts of organic acids such as citric acid, tartaric acid, and malic acid; persulfates; manganates; and nitrosophenol. Among these bleaching agents, iron (III) ethylene diamine tetraacetate and persulfates are preferably used in view of rapidness of processing and pollution consideration. Furthermore, ethylene diamine tetraacetic acid-iron (III) complex salt is useful in single bleaching bath, particularly in combined blix bath.

The bleaching bath or blix bath may also contain various accelerators if desired.

In general, blixing or fixing is followed by washing. In order to prevent precipitation or save water, various known compounds may be used in the washing process. For example, in order to prevent precipitation, a water softener such as an inorganic phosphoric acid, an aminopolycarboxylic acid, and an organic phosphoric acid, a germicide, and an antimolding agent for preventing production of various bacteria, algae, and mold, a hardener such as a magnesium salt and an aluminum salt, or a surface active agent for preventing drying load and mark may be used if desired. Alternatively, compounds as described in L. E. West, ed., *Water Quality Criteria* and *Photographic Science and Engineering,* (1965) Vol. 6, pp. 344–359, may be used. In particular, the addition of a chelating agent or an antimolding agent is effective.

Washing is generally such that two or more tanks are operated in a counterflow manner to save water. A multistage counterflow stabilizing process as described in Japanese Patent Application (OPI) No. 8543/82 may be effected instead of washing process. The stabilizing bath comprises various compounds in order to stabilize images developed. Typical examples of such a compound include various buffers for adjusting the pH of film (for example, 3 to 8) (e.g., combinations of a borate, a metaborate, a borax, a phosphate, a carbonate, potassium hydroxide, sodium hydroxide, aqueous ammonia, a monocarboxylic acid, a dicarboxylic acid, a polycarboxylic acid, and the like), and formalin. Besides the above-mentioned compounds a, water softener (e.g., an inorganic phosphoric acid, an aminopolycarboxylic acid, an organic phosphoric acid, an aminopolyphosphonic acid, and phosphonocarboxylic acid), germicide (benzoisothiaolinone, isothiazolone, 4-thiazolinebenzimidazole, and a halogenated phenol), a surface active agent, a fluororescent brightening agent, a hardener and other additives may be used. These compounds may be used singly or in combination.

Preferred examples of film pH adjustors which are used after processing include various ammonium salts such as ammonium chloride, ammonium nitrate, ammonium sulfate, ammonium phosphate, ammonium sulfite, and ammonium thiosulfate.

In order to simplify and expedite development, a color-developing agent may be incorporated in the silver halide photographic light-sensitive material. The incorporation of the color-developing agent is preferably accomplished by using various precursors of the color-developing agent.

In order to accelerate color development, various 1-phenyl-3-pyrazolidones may be incorporated in the present silver halide photographic light-sensitive material, if desired.

Typical examples of such a compound are described in Japanese Patent Application (OPI) Nos. 64339/81, 144547/82, 211147/82, 50532/83, 50536/83, 50533/83, 50534/83, 50535/83, and 115438/83.

The various processing solutions of the present invention are used at a temperature of from 10° to 50° C., and it is preferable to conduct development at from 33° to 38° C. In order to save silver to be used for the light-sensitive material, a processing utilizing cobalt intensification or hydrogen peroxide intensification as described in West German Pat. No. 2,226,770 and U.S. Pat. No. 3,674,499 may be effected.

The various processing baths may be optionally provided with features such as a heater, temperature sensor, liquid level sensor, circulating pump, filter, floating cover, and squeegee.

The present invention will be further illustrated in the following examples, but the present invention should not be construed as being limited thereto.

EXAMPLE 1

A light-sensitive material (A), as a control, was prepared by applying the following layers to a cellulose triacetate support, in the order described.

Light-sensitive material (A)

(1) A layer containing a silver chlorobromide emulsion (Br: 50 mol%) (1.0 g/m$^2$ in terms of amount of silver), the exemplary magenta coupler M-1 of formula (I) (1.158 mmol/m$^2$), phosphoric tri-n-octylester (1.244 g/m$^2$), and gelatin (2.896 g/m$^2$).

(2) A layer containing gelatin (1.781 g/m$^2$) and sodium salt of 2,4-dichloro-6-hydroxy-s-triazine.

Light-sensitive materials (B), (C), (D), and (E) were prepared as follows:

Light-sensitive material (B)

A light-sensitive material (B) was prepared in the same manner as used for the light-sensitive material (A) except that the layer (1) further contained the exemplary compound (1) of formula (II) (0.06 mmol/m$^2$).

Light-sensitive material (C)

A light-sensitive material (C) was prepared in the same manner as used for the light-sensitive material (A) except that the layer (1) further contained the comparative exemplary compound (1) (0.06 mmol/m$^2$).

Light-sensitive material (D)

A light-sensitive material (D) was prepared in the same manner as used for the light-sensitive material (A) except that the layer (1) further contained the exemplary compound (3) of formula (II) (0.06 mmol/m$^2$).

Light-sensitive material (E)

A light-sensitive material (E) was prepared in the same manner as used for the light-sensitive material (A) except that the layer (1) further contained the comparative exemplary compound (2) (0.06 mmol/m$^2$).

To evaluate these light-sensitive materials, the following color-developing solution (I), (II), and (III) were prepared.

Comparative compounds (1)

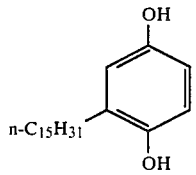

(2)

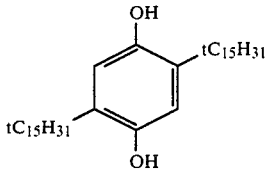

Color-developing solution (I) composition

| | |
|---|---|
| Trisodium nitrilo triacetate | 2.0 g |
| Benzyl alcohol | 15 ml |
| Diethylene glycol | 10 ml |
| Sodium sulfite | 0.2 g |
| Potassium bromide | 0.5 g |
| Hydroxylamine sulfate | 3.0 g |
| 4-amino-3-methyl-N—ethyl-N—[β-methanesulfonamide)ethyl]p-phenylenediamine sulfate | 5.0 g |
| Sodium carbonate (monohydrate) | 30 g |
| Water to make (pH 10.1) | 1,000 ml |

Color-developing solution (II) composition

This composition was prepared in the same manner as used for the color-developing solution (I) composition except that sodium sulfite was used in an amount of 1.7 g instead of 0.2 g.

Color-developing solution (III) composition

This composition was prepared in the same manner as used for the color-developing solution (I) except that sodium sulfite was used in an amount of 3.3 g instead of 0.2 g.

Blix bath solution composition

| | |
|---|---|
| Ammonium thiosulfate (70 wt %) | 150 ml |
| Sodium sulfite | 15 g |
| Iron ammonium ethylenediaminetetraacetate | 55 g |
| Disodium ethylenediaminetetraacetate | 4 g |
| Water to make | 1,000 ml |

Three sheets of the light-sensitive materials (A) to (E) each were imagewise exposed to light through a continuous wedge. Each of these specimens were then subjected to development with the above three developing solutions as follows:

Processing steps

| | Temperature | Time |
|---|---|---|
| Color development | 33° C. | 3 min. 30 sec. |
| Blix | 33° C. | 1 min. 30 sec. |
| Washing with water | 25–35° C. | 3 min. |
| Drying | 80° C. | enough for dryness |

The specimens thus processed were then measured for optical transmission density with respect to green light by means of a color densitometer. Then, these specimens were evaluated by a value obtained by subtracting 2.5 from the density given by the color-developing solutions (I) and (III) at an exposure which provides a density of 2.5 when processed with the color-developing solution (II).

TABLE 1

| Light-Sensitive Material | $\Delta D_1$*1 | $\Delta D_2$*2 |
|---|---|---|
| A (control) | +0.38 | −0.32 |
| B (present invention) | +0.05 | −0.04 |
| C (comparison) | +0.17 | −0.19 |
| D (present invention) | +0.07 | −0.09 |
| E (comparison) | +0.22 | −0.25 |

*1 $\Delta D_1 = D_1 - 2.5$ wherein $D_1$ is the density provided by the color-developing solution (I) at an exposure which provides a density of 2.5 when processed with the color-developing solution (II).
*2 $\Delta D_2 = D_2 - 2.5$ wherein $D_2$ is the density provided by the color-developing solution (III) at an exposure which provides a density of 2.5 when processed with the color-developing solution (II).

Table 1 shows that the light-sensitive materials containing the compound of the present invention of formula (II) are much less than the comparative light-sensitive materials free of the compound of the present invention in the change of density due to the change in the amount of sodium sulfite in the color-developing solution. This means that the present light-sensitive materials of the present invention having a remarkably reduced dependency on the amount of sodium sulfite in the color-developing solution.

EXAMPLE 2

A color light-sensitive material (F) for control was prepared by applying a 1st layer (lowermost layer) to a 7th layer (uppermost layer) to a paper laminated with polyethylene on both sides as shown below.

7th layer: protective layer

| | |
|---|---|
| Gelatin | 1600 mg/m$^2$ |

6th layer: ultraviolet absorbing layer

| | |
|---|---|
| Ultraviolet absorber (*a) | 350 mg/m$^2$ |

-continued

| | |
|---|---|
| Solvent-dibutylphthalate(DBP) | 60 mg/m$^2$ |
| Gelatin | 1,000 mg/m$^2$ |

5th layer: red-sensitive layer

| | |
|---|---|
| Silver chlorobromide emulsion silver bromide: 50 mol %) | 250 mg/m$^2$ (calculated in terms of amount of silver) |
| Cyan coupler (*d) | 400 mg/m$^2$ |
| Ultraviolet absorber (*a) | 100 mg/m$^2$ |
| Solvent (DBP) | 240 mg/m$^2$ |
| Gelatin | 600 mg/m$^2$ |

4th layer: color stain-preventing layer

| | |
|---|---|
| Color stain-preventing agent (*b) | 200 mg/m$^2$ |
| Ultraviolet absorber (*a) | 150 mg/m$^2$ |
| Solvent (DBP) | 60 mg/m$^2$ |
| Gelatin | 1,000 mg/m$^2$ |

3rd layer: green-sensitive layer

| | |
|---|---|
| Silver chlorobromide emulsion silver bromide: 70 mol %) | 180 mg/m$^2$ (calculated in terms of amount of silver) |
| Magenta coupler (exemplary compound M-5 of formula (I)) | 270 mg/m$^2$ |
| Discoloration inhibitor (*c) | 150 mg/m$^2$ |
| Solvent (TOP) | 270 mg/m$^2$ |
| Gelatin | 1,000 mg/m$^2$ |

2nd layer: color stain-preventing layer

| | |
|---|---|
| Color stain-preventing agent (*b) | 200 mg/m$^2$ |
| Solvent (DBP) | 100 mg/m$^2$ |
| Gelatin | 1,000 mg/m$^2$ |

1st layer: blue-sensitive layer

| | |
|---|---|
| Silver chlorobromide emulsion silver bromide: 80 mol %) | 400 mg/m$^2$ (calculated in terms of amount of silver) |
| Yellow coupler (*e) | 690 mg/m$^2$ |
| Solvent (DBP) | 500 mg/m$^2$ |
| Gelatin | 1,200 mg/m$^2$ |

Support

Paper laminated with polyethylene on both sides

*a 2-(2-hydroxy-3-sec-butyl-5-tert-butylphenyl)-benzotriazole
*b 2,5-dioctyl hydroquinone
*c 3,3,3',3'-tetramethyl-5,6,5',6'-tetrapropyloxy-bis-1,1'-spiroindane

*d

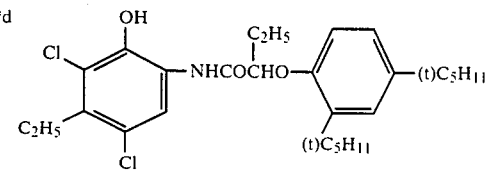

-continued

*e

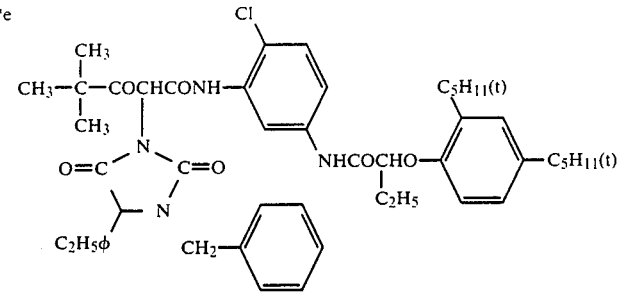

Light-sensitive material (G)

A light-sensitive material (G) was prepared in the same manner as used for the light-sensitive material (F), except that the 3rd layer further contained the exemplary compound (1) of formula (II) (8.4 mg/m$^2$).

Light-sensitive material (H)

A light-sensitive material (H) was prepared in the same manner as used for the light-sensitive material (F), except that the 3rd layer further contained the comparative exemplary compound (1) (8.4 mg/m$^2$).

For evaluation, the light-sensitive materials (F) to (H) thus prepared were exposed to green light through a continuous wedge. The specimens thus exposed were then processed in the same manner as in Example 1.

These specimens were measured for the optical reflection density of the magenta color image thus obtained with respect to green light. These specimens were then evaluated by a value obtained by subtracting 2.0 from the density given by the color-developing solution (I) and (III) at an exposure which provides a density of 2.0 when processed with the color-developing agent (II) of Example 1.

The results are shown in Table 2.

TABLE 2

| Light-Sensitive Material | $\Delta D_1^{G*1}$ | $\Delta D_2^{G*2}$ |
|---|---|---|
| F (control) | +0.21 | −0.24 |
| G (present invention) | +0.04 | −0.03 |
| H (comparison) | +0.10 | −0.15 |

*1 $\Delta D_1^G = D_1^G - 2.0$ wherein $D_1^G$ is the density provided by the color-developing solution (I) at an exposure which provides a magenta density of 2.0 when processed with the color-developing solution (II).

*2 $\Delta D_2^G = D_2^G - 2.0$ wherein $D_2^G$ is the density provided by the color-developing solution (III) at an exposure which provides a magenta density of 2.0 when processed with the color-developing solution (III).

Table 2 shows that the present invention has a remarkably improved dependency on the amount of sodium sulfite in the color-developing solution as in Example 1 even when applied to a practical multicolor light-sensitive material.

EXAMPLE 3

A light-sensitive material (I) was prepared by applying the following compositions (1st layer to 11th layer) to a paper support laminated with polyethylene on both sides in layers. The polyethylene to which the 1st layer was applied contained titanium white as a white pigment and an extremely small amount of ultramarine as a bluish dye.

Photographic layer composition

The coating amounts are shown by the unit of g/m$^2$, and the amount of silver halide was calculated in terms of amount of silver.

1st layer: antihalation coating

| | |
|---|---|
| Black colloidal silver | 0.10 |
| Gelatin | 0.2 |

2nd layer: low sensitivity red-sensitive layer

| | |
|---|---|
| Silver iodobromide emulsion spectrally sensitized by red sensitizing dyes (*5 and *4) (silver iodide: 3.5 mol %; average particle size: 0.7 μm) | 0.15 (calculated in terms of amount of silver) |
| Gelatin | 1.0 |
| Cyan coupler (*3) | 0.30 |
| Discoloration inhibitor (*2) | 0.15 |
| Coupler solvent (*18 and *1) | 0.06 |

3rd layer: high sensitivity red-sensitive layer

| | |
|---|---|
| Silver iodobromide emulsion spectrally sensitized by red sensitizing dyes (*5 and *4) (silver iodide: 8.0 mol %; average particle size: 0.7 μm) | 0.10 (calculated in terms of amount of silver) |
| Gelatin | 0.50 |
| Cyan coupler (*3) | 0.10 |
| Discoloration inhibitor (*2) | 0.05 |
| Coupler solvent (*18 and *1) | 0.02 |

4th layer: intermediate layer

| | |
|---|---|
| Yellow colloidal silver | 0.02 |
| Gelatin | 1.00 |
| Color stain inhibitor (*14) | 0.08 |
| Color stain inhibitor solvent (*13) | 0.16 |
| Polymer latex (*6) | 0.40 |

5th layer: low sensitivity green-sensitive layer

| | |
|---|---|
| Silver iodobromide emulsion spectrally sensitized by a green sensitizing dye (*12) (silver iodide: 2.5 mol %; average particle size: 0.4 μm) | 0.08 (calculated in terms of amount of silver) |
| Gelatin | 0.70 |
| Magenta coupler (*11) | 0.30 |
| Discoloration inhibitor A (*10) | 0.05 |
| Discoloration inhibitor B (*9) | 0.05 |
| Discoloration inhibitor C (*8) | 0.02 |

-continued

| | |
|---|---|
| Coupler solvent (*7) | 0.15 |

6th layer: high sensitivity green-sensitive layer

| | |
|---|---|
| Silver iodobromide emulsion spectrally sensitized by a green sensitizing dye (*12) (silver iodide: 3.5 mol %; average particle size: 0.9 μm) | 0.08 (calculated in terms of amount of silver) |
| Gelatin | 0.70 |
| Magenta coupler (*11) | 0.30 |
| Discoloration inhibitor A (*10) | 0.05 |
| Discoloration inhibitor B (*9) | 0.05 |
| Discoloration inhibitor C (*8) | 0.02 |
| Coupler solvent (*7) | 0.15 |

7th layer: yellow filter layer

| | |
|---|---|
| Yellow colloidal silver | 0.20 |
| Gelatin | 1.00 |
| Color stain inhibitor (*14) | 0.06 |
| Color stain inhibitor solvent (*13) | 0.24 |

8th layer: low sensitivity blue-sensitive layer

| | |
|---|---|
| Silver iodobromide emulsion spectrally sensitized by a blue sensitizing dye (*16) (silver iodide: 2.5 mol %; average particle size: 0.5 μm) | 0.15 (calculated in terms of amount of silver) |
| Gelatin | 0.50 |
| Yellow coupler (*15) | 0.20 |
| Coupler solvent (*18) | 0.05 |

9th layer: high sensitivity blue-sensitive layer

| | |
|---|---|
| Silver iodobromide emulsion spectrally sensitized by a blue sensitizing dye (*16) (silver iodide: 2.5 mol %; average particle size: 1.4 μm) | 0.20 (calculated in terms of amount of silver) |
| Gelatin | 0.50 |
| Yellow coupler (*15) | 0.20 |
| Coupler solvent (*18) | 0.05 |

10th layer: ultraviolet absorbing layer

| | |
|---|---|
| Gelatin | 1.50 |
| Ultraviolet absorber (*19) | 1.0 |
| Ultraviolet absorber solvent (*18) | 0.30 |
| Color stain inhibitor (*17) | 0.08 |

11th layer: protective layer

| | |
|---|---|
| Gelatin | 1.0 |

The compounds used in the above compositions were as follows:

*1 Dioctyl phthalate
*2 2-(2-hydroxy-3-sec-buty-5-t-butylphenyl)benzotriazole
*3 2-[α-(2,4-di-t-amylphenoxy)butylamide]-4,6-dichloro-5-ethylphenol
*4 Sodium 5,5'-dichloro-3,3'-di(3-sulfobuty)-9-ethylthiacarbonyl cyanine -continued

*5 Triethyl ammonium-3-[2-{2-[3-(3-sulfopropyl)naphtho-(1,2-d)thiazoline-2-ilidenemethyl]-1-butenyl}-3-naphtho(1,2-d)thiazoline]propanesulfonate
*6 Polyethylacrylate
*7 Phosphoric trioctylester
*8 2,4-di-t-hexylhydroquinone
*9 Di(2-hydroxy-3-t-butyl-5-methylphenyl)methane
*10 3,3,3',3'-tetramethyl-5,6,5',6'-tetrapropoxy-1,1'-bis-spiroindane
*11 Magenta coupler (exemplary compound M-5 of formula (I))
*12 Sodium 5,5'-diphenyl-9-ethyl-3,3'-disulfopropyloxacarbocyanine
*13 Phosphoric o-cresyl ester
*14 2,4-di-t-octylhydroquinone
*15 α-pivaloyl-α-[(2,4-dioxo-1-benzyl-5-ethoxyhydantoin-3-yl-2-chloro-5-(α-2,4-dioxo-t-amylphenoxy)butanamido]-acetanilide
*16 Triethyl ammonium 3-[2-(3-benzylrhodanine-5-ilidene)-3-benzoxazolinyl]propanesulfonate
*17 2,4-di-sec-octyl hydroquinone
*18 Phosphoric trinonylester
*19 5-chloro-2-(2-hydroxy-3-t-butyl-5-t-octyl)phenylbenztriazole
*20 1,4-bis(vinylsulfonylacetamide)ethane Light-sensitive materials (J), (K), (L), and (M) were prepared as follows:

Light-sensitive material (J)

A light-sensitive material (J) was prepared in the same manner as used for the light-sensitive material (I), except that the 5th layer and the 6th layer each further contained the comparative exemplary compound (2) (12 mg/m$^2$).

Light-sensitive material (K)

A light-sensitive material (K) was prepared in the same manner as used for the light-sensitive material (I), except that the 5th layer and the 6th layer each further contained the exemplary compound (1) of formula (II) (12 mg/m$^2$).

Light-sensitive material (L)

A light-sensitive material (L) was prepared in the same manner as used for the light-sensitive material (I), except that the 5th layer and the 6th layer each further contained the exemplary compound (2) of formula (II) (12 mg/m$^2$).

Light-sensitive material (M)

A light-sensitive material (M) was prepared in the same manner as used for the light-sensitive material (I), except that the 5th layer and the 6th layer each further contained the exemplary compound (3) of formula (II) (12 mg/m$^2$).

Processing solution composition

1st developing agent

| | |
|---|---|
| Hexasodium nitrilo-N,N,N—trimethylene phosphate | 3.0 g |
| Potassium sulfite anhydride | 20.0 g |
| Sodium thiocyanate | 1.2 g |
| 1-phenyl-4-methyl-hydroxymethyl-3-pyrazolidone | 2.0 g |
| Sodium carbonate anhydride | 3.0 g |
| Potassium hydroquinone monosulfonate | 30.0 g |
| Potassium bromide | 2.5 g |
| Potassium iodide (0.1% aqueous solution) | 2 ml |
| Water to make | 1,000 ml |

-continued

| | |
|---|---|
| pH | 9.7 |

Color-developing agent (I)

| | |
|---|---|
| Benzyl alcohol | 15.0 ml |
| Ethylene glycol | 12.0 ml |
| Hexasodium nitrilo-N,N,N—trimethylene-phosphate | 3.0 g |
| Sodium carbonate | 26.0 g |
| Sodium sulfite | 0.2 g |
| 1,2-di(2'-hydroxyethyl)mercaptoethane | 0.6 g |
| Hydroxylamine sulfate | 3.0 g |
| 3-methyl-4-amino-N—ethyl-β-methane-sulfonamido ethyl aniline sulfate | 5.0 g |
| Sodium bromide | 5.0 g |
| Potassium iodide (0.1% aqueous solution) | 0.5 ml |
| Water to make | 1,000 ml |
| pH | 10.5 |

Color-developing agent

A color-developing agent (II) was prepared in the same manner as used for the color-developing agent (I) except that 2.2 g of sodium sulfite was used.

Color-developing agent (III)

A color-developing agent (III) was prepared in the same manner as used for the color-developing agent (I) except that 4.2 g of sodium sulfite was used.

Blix bath

| | |
|---|---|
| Iron (III) ammonium ethylenediamine-N,N,N',N'—tetraacetate (dihydride) | 8.0 g |
| Sodium metabisulfite | 15.0 g |
| Ammonium thiosulfate (58% aqueous solution) | 126.6 ml |
| 2-mercapto-1,3,5-triazole | 0.20 g |
| Water to make | 1,000 ml |
| pH | 6.5 |

Three sheets of the light-sensitive materials (I) through (M) thus obtained were then gradation-wise exposed to light through a continuous wedge. These light-sensitive materials thus exposed were developed with the above three developing agents in accordance with the following processing steps:

Processing steps

| | | |
|---|---|---|
| 1st development (black-and-white negative development) | 38° C. | 75 sec. |
| Washing with water | 38° C. | 90 sec. |
| Reversal exposure | 100 lux | |
| Color development | 38° C. | 135 sec. |
| Washing with water | 38° C. | 45 sec. |
| Blix | 38° C. | 120 sec. |
| Washing with water | 38° C. | 135 sec. |

These specimens were measured for the optical reflex density of magenta images thus obtained with respect to green light. These specimens were then evaluated by a value obtained by subtracting 2.0 from the density given by the color-developing solution (I) and (III) at an exposure which provides a density of 2.0 when processed with the color-developing solution (II).

The results are shown in Table 3.

TABLE 3

| Light-Sensitive Material | $\Delta D_1^{G*1}$ | $\Delta D_2^{G*2}$ |
|---|---|---|
| I (control) | +0.16 | −0.14 |
| J (comparative) | +0.13 | −0.13 |
| K (present invention) | +0.04 | −0.07 |
| L (present invention) | +0.04 | −0.08 |
| M (present invention) | +0.06 | −0.08 |

*1 and *2: as defined in Table 2 of Example 2

Table 3 shows that the present invention shows remarkably less change in its photographic properties with respect to the amount of sulfite in the color-developing agent than the comparative light-sensitive material, even when applied to a reversal color light-sensitive material.

EXAMPLE 4

Light-sensitive materials (N) and (P) were prepared as follows:

Light-sensitive material (N)

A light-sensitive material (N) was prepared in the same manner as used for the light-sensitive material (F) of Example 2, except that the 2nd layer further contained the exemplary compound (1) of formula (II) (10.5 mg/m$^2$).

Light-sensitive material (P)

A light-sensitive material (P) was prepared in the same manner as used for the light-sensitive material (F) of Example 2 except that the 4th layer further contained the exemplary compound (1) of formula (II) (10.5 mg/m$^2$).

The light-sensitive material (F) and the light-sensitive materials (N) and (P) thus obtained were then subjected to examination in the same manner as used in Example 2.

The results are shown in Table 4.

TABLE 4

| Light-Sensitive Material | $\Delta D_1^G$ | $\Delta D_2^G$ |
|---|---|---|
| F (control) | +0.22 | −0.24 |
| N (present invention) | +0.09 | −0.08 |
| P (present invention) | +0.12 | −0.10 |

Table 4 shows that the addition of the compound of the present invention of the formula (II) to the intermediate layer remarkably reduces the dependency of the photographic properties on the amount of sodium sulfite in the color-developing agent, providing improved photographic properties.

The present light-sensitive material can thus provide a lower dependency of the magenta color density on the concentration of sulfite in the developing agent. However, the mechanism of this effect is not yet completely clear.

The cause of the phenomenon that as the concentration of sulfite in the developing agent increases the magenta color density decreases is thought to be as follows:

The oxidized form of a developing agent produced as a result of the development of exposed silver halide by the developing agent undergoes a competitive reaction between reaction with a coupler and reaction with sulfite. Therefore, if the same amount of the oxidized form of developing agent is produced in a developer, the developer having a higher sulfite concentration provides a less color density. However, the compound of formula (I) shows a behavior for which the above-mentioned mechanism cannot sufficiently account.

The compound of formula (II) of the present invention is capable of reacting with an oxidized form of developing agent, and thus serves as a second competitive compound for a coupler as does the sulfite which is a competitive compound for the coupler. It is thus thought that the compound of formula (II) consequently serves to reduce the dependency of color density on the sulfite concentration.

Furthermore, the sulfonic group-containing hydroquinone derivative of formula (II) seems to be more susceptible to reaction with sulfite than the corresponding hydroquinone derivative free of a sulfonic group. Therefore, it can be believed that the compound of formula (II) serves more effectively as a "sulfite scavenger." Thus, the mechanism of the effect of the compound of formula (II) is presently not completely clear. Anyway, it is true that the present invention can provide a silver halide color photographic material having less sulfite concentration dependency and an improved color reproducibility.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising at least one silver halide light-sensitive emulsion layer associated with a magenta coupler provided on a support, wherein at least one of said silver halide emulsion layer and the layer(s) adjacent to the emulsion layer contains a hydroquinone derivative, wherein said coupler is at least one compound selected from the group consisting of compounds represented by formula (I), bis-compounds derived from the compounds, and polymers having coupler residues derived from the compounds,

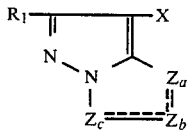

(I)

wherein $R_1$ represents a hydrogen atom or a substituent; X represents a hydrogen atom or a group which can be released therefrom upon coupling with an oxidized form of an aromatic primary amine-developing agent; and Za, Zb, and Zc each represents methine, substituted methine, =N—, or —NH— group, one of Za-Zb bond and Zb-Zc bond is a double bond and the other is a single bond, and when the Zb-Zc bond is a carbon-carbon double bond, it can form a part of an aromatic ring, or $R_1$ or X is a group forming the bis-compound or the polymer, or Za, Zb or Zc represents a substituted methine group forming the bis-compound or the polymer, and said hydroquinone derivative is represented by formula (II)

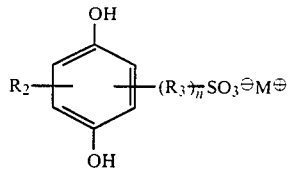

(II)

wherein $R_2$ represents a substituted or unsubstituted alkyl group, alkoxy group, aromatic group, or alkylthio group; $R_3$ represents an alkylene group; n represents an integer of 0 or 1; and M⊕ represents a cation wherein said magenta coupler is incorporated in the light-sensitive material in an amount of from $1\times10^{-3}$ mol to 1 mol per mol of silver halide in said light-sensitive silver halide emulsion layer.

2. A silver halide color photographic light-sensitive material as in claim 1, wherein $R_1$ represents a halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycarbonylamino group, aryloxycarbonylamino group, sulfonamide group, carbamoyl group, acyl group, sulfamoyl group, sulfonyl group, sulfinyl group, alkoxycarbonyl group, aryloxycarbonyl group, or substituted groups thereof.

3. A silver halide color photographic light-sensitive material as in claim 1, wherein said compound represented by formula (I) is selected from the group consisting of compounds represented by formulae (III) through (IX)

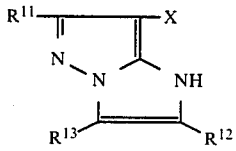

(III)

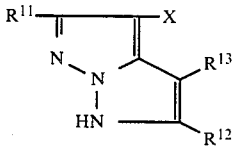

(IV)

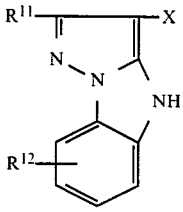

(V)

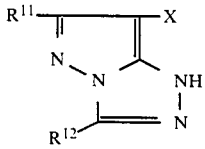

(VI)

-continued

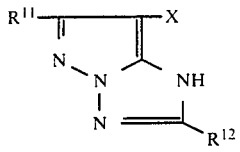

(VII)

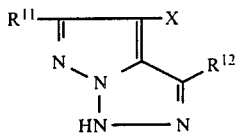

(VIII)

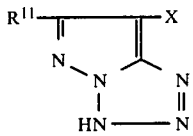

(IX)

wherein $R^{11}$, $R^{12}$, and $R^{13}$ each represents a hydrogen atom, halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycabonylamino group, aryloxycarbonylamino group, sulfonamide group, carbamoyl group, acyl group, sulfamoyl group, sulfonyl group, sulfinyl group, alkoxycarbonyl group, aryloxycarbonyl group, substituted groups thereof; X represents a hydrogen atom, halogen atom, carboxy group, or a coupling-off group which can be bonded to the coupling-position carbon atom via an oxygen, nitrogen, or sulfur atom or substituted groups thereof; or $R^{11}$, $R^{12}$, $R^{13}$, or X represents a group forming a bis-compound or a polymer, or $R^{12}$ and $R^{13}$ in formula (III) and (IV) bond to each other to form a 5-, 6-, or 7-membered ring.

4. A silver halide color photographic light-sensitive material as in claim 3, wherein said coupler is a bis-compound and wherein $R^{11}$, $R^{12}$, $R^{13}$, or X represents a divalent group forming linking group of the bis-compound.

5. A silver halide color photographic light-sensitive material as in claim 4, wherein said linking group is selected from the group consisting of a substituted or unsubstituted alkylene group or a substituted or unsubstituted group having at least two alkylene groups linked with each other by an oxygen atom to form a divalent group, substituted or unsubstituted phenylene group, —NHCO—$R^{14}$—CONH— group (wherein $R^{14}$ represents a substituted or unsubstituted alkylene or phenylene group), or —S—$R^{15}$—S— group (wherein $R^{15}$ represents a substituted or unsubstituted alkylene group).

6. A silver halide color photographic light-sensitive material as in claim 3, wherein X represents a group obtained by converting the monovalent group described in claim 3 to a divalent group.

7. A silver halide color photographic light-sensitive material as in claim 3, wherein said coupler is a polymer containing a monomer represented by formula (I) wherein $R^{11}$, $R^{12}$, $R^{13}$, or X represents an ethylenic unsaturated group having a linkage group selected from the group consisting of a substituted or unsubstituted alkylene group, a substituted or unsubstituted group having at least two alkylene groups linked with each other by an oxygen atom to form a divalent group, substituted or unsubstituted phenylene group, —NHCO—, —CONH—, —O—, and substituted and unsubstituted aralkylene groups, and groups formed by combination of two or more of these groups.

8. A silver halide color photographic light-sensitive material as in claim 1, wherein said polymer is one selected from the group consisting of (i) a polymer comprising at least one of monomers derived from the compounds represented by formula (I) and (ii) a copolymer comprising at least one of monomers derived from the compounds represented by formula (I) and a colorless ethylenic monomer which does not undergo coupling reaction with the oxidized form of an aromatic primary amine-developing agent.

9. A silver halide color photographic light-sensitive material as in claim 1, wherein the substituents of said substituted alkyl group is a group selected from the group consisting of a hydroxy group, halogen atom, —$SO_3M$, —COOM (wherein M represents H, an alkali metal atom, an alkaline earth metal atom, and $NH_4$), amino group, alkoxy group, alkylthio group, aryloxy group, arylthio grou, sulfonamido group, alkylamido group, and aldehyde group.

10. A silver halide color photographic light-sensitive material as in claim 1, wherein the substituents of said substituted alkoxy group is a group consisting of an alkoxy group, phenyloxy group, halogen atom, and amino group.

11. A silver halide color photographic light-sensitive material as in claim 1, wherein said substituted aromatic group is a substituted phenyl group having a substituent selected from the group consisting of an alkyl group, alkoxy group, and halogen atom.

12. A silver halide color photographic light-sensitive material as in claim 1, wherein the substituents of said substituted alkylthio group is an alkoxy group.

13. A silver halide color photographic light-sensitive material as in claim 1, wherein said alkylene group has from 1 to 4 carbon atoms.

14. A silver halide color photographic light-sensitive material as in claim 1, wherein $M^{\oplus}$ represents a hydrogen ion, an alkali metal ion, an alkaline earth metal ion or an ammonium ion.

15. A silver halide color photographic light-sensitive material as in claim 1, wherein $R_2$ of formula (II) contains at least 6 carbon atoms.

16. A silver halide color photographic light-sensitive material as in claim 1, wherein said magenta coupler is incorporated to at least one of the light-sensitive silver halide emulsion layer and the layer(s) adjacent thereto.

17. A silver halide color photographic light-sensitive material as in claim 1, wherein said compound of formula (II) is incorporated to the light-sensitive material in an amount of from 0.1 to 50 mol% of the amount of the magenta coupler.

18. A method for forming a color image which comprises developing a silver halide color photographic light-sensitive material using a developing solution containing an aromatic primary amine-developing agent, said light-sensitive material comprising at least one silver halide light-sensitive emulsion layer associated with a magenta coupler provided on a support, wherein at least one of said silver halide emulsion layer and the layer(s) adjacent to the emulsion layer contain a hydroquinone derivative, wherein said coupler is at least one compound selected from the group consisting of compounds represented by formula (I), bis-compounds derived from the compounds, and polymers having coupler residues derived from the compounds,

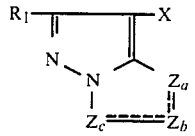

(I)

wherein $R_1$ represents a hydrogen atom or a substituent; X represents a hydrogen atom or group which can be released therefrom upon coupling with an oxidized form of an aromatic primary amine-developing agent; and Za, Zb, and Zc each represents a methine, substituted methine, =N—, or —NH— group, one of Za-Zb bond and Zb-Zc bond is a double bond and the other is a single bond, and when the Zb-Zc bond is a carbon-carbon double bond, it can form a part of an aromatic ring, or $R_1$ or X is a group forming the bis-compound or the polymer, or Za, Zb, or Zc represents a substituted methine group forming the bis-compound or the polymer, and said hydroquinone derivative is represented by formula (II)

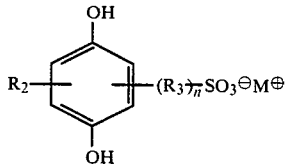

(II)

wherein $R_2$ represents a substituted or unsubstituted alkyl group, alkoxy group, aromatic group, or alkylthio group; $R_3$ represents an alkylene group; n represents an integer of 0 or 1; and M represents a cation, wherein said color developing is conducted using a developer containing a sulfite as a preservative.

19. A silver halide color photographic light-sensitive material as in claim 16, wherein said compound represented by formula (II) is incorporated in the light-sensitive silver halide emulsion layer containing the magenta coupler.

20. A silver halide color photographic light-sensitive material as in claim 1, wherein said compound represented by formula (II) is substantially non-diffusible in a hydrophilic colloid layer.

21. A silver halide color photographic light-sensitive material as in claim 1, wherein $R_2$ contains at least 10 carbon atoms.

22. A silver halide color photographic light-sensitive material as in claim 1, wherein $R_2$ contains at least 15 carbon atoms.

23. A silver halide color photographic light-sensitive material as in claim 1, wherein n in formula (II) is 0.

24. A silver halide color photographic light-sensitive material as in claim 15, wherein n in formula (II) is 0.

25. A silver halide color photographic light-sensitive material as in claim 1, wherein the hydroquinone derivitive is incorporated in the emulsion layer containing the magenta coupler.

26. A silver halide color photographic light-sensitive material as in claim 1, wherein Za, Zb, and Zc each represents a methine, substituted methine =N—, or —NH—, one of Za-Zb bond and Zb-Zc bond is a double bond and the other is a single bond, or $R^1$ or X is a group forming the bis-compound or the polymer, or Za, Zb, or Zc represents a substituted methine forming the bis-compound or the polymer.

27. A silver halide color photographic light-sensitive material as in claim 1, wherein said compound represented by formula (I) is selected from the group consisting of compounds represented by formulae (III), (IV) and (VI) to (IX)

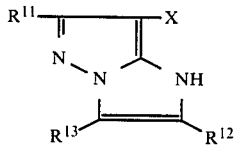

(III)

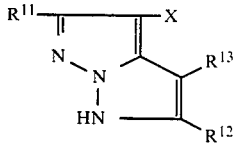

(IV)

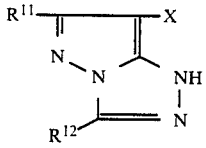

(VI)

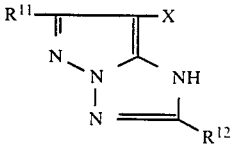

(VII)

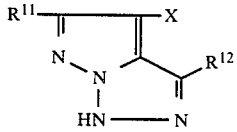

(VIII)

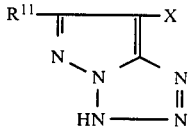

(IX)

wherein $R^{11}$, $R^{12}$, and $R^{13}$ each represents a hydrogen atom, halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycabonylamino group, aryloxycarbonylamino group, sulfonamide group, carbamoyl group, acyl group, sulfamoyl group, sulfonyl group, sulfinyl group, alkoxycarbonyl group, aryloxycarbonyl group, substituted groups thereof; X represents a hydrogen atom, halogen atom, carboxy group, or a coupling-off group which can be bonded to the coupling-position carbon atom via an oxygen, nitrogen, or sulfur atom or substituted groups thereof; or $R^{11}$, $R^{12}$, $R^{13}$, or X represents a group forming a bis-compound or a polymer, or $R^{12}$ and $R^{13}$ in formula (III) and (IV) bond to each other to form a 5-, 6-, or 7-membered ring other than a benzene ring.

28. A method as in claim 18 wherein $R_1$ represents a halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycabonylamino group, aryloxycarbonylamino group, sulfonamide group, carbamoyl group, acyl group, sulfamoyl group, sulfonyl group, sulfinyl group, alkoxycarbonyl group, aryloxycarbonyl group, or substituted groups thereof.

29. A method as in claim 18, wherein said compound represented by formula (I) is selected from the group consisting of compounds represented by formulae (III) through (IX)

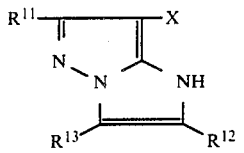
(III)

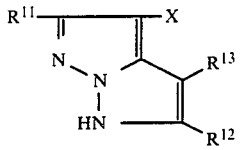
(IV)

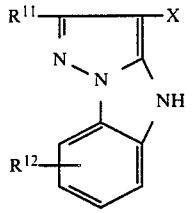
(V)

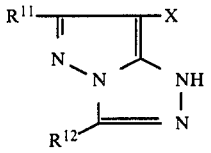
(VI)

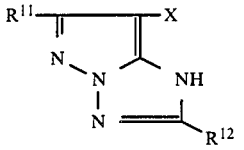
(VII)

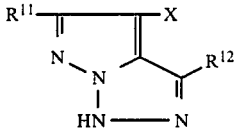
(VIII)

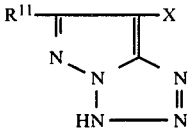
(IX)

wherein $R^{11}$, $R^{12}$, and $R^{13}$ each represents a hydrogen atom, halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycabonylamino group, aryloxycarbonylamino group, sulfonamide group, carbamoyl group, acyl group, sulfamoyl group, sulfonyl group, sulfinyl group, alkoxycarbonyl group, aryloxycarbonyl group, substituted groups thereof; X represents a hydrogen atom, halogen atom, carboxy group, or a coupling-off group which can be bonded to the coupling-position carbon atom via an oxygen, nitrogen, or sulfur atom or substituted groups thereof; or $R^{11}$, $R^{12}$, $R^{13}$, or X represents a group forming a bis compound or a polymer, or $R^{12}$ and $R^{13}$ in formula (III) and (IV) bond to each other to form a 5-, 6-, or 7-membered ring.

30. A method as in claim 29, wherein said coupler is a bis-compound and wherein $R^{11}$, $R^{12}$, $R^{13}$, or X represents a divalent group forming linking group of the bis-compound.

31. A method as in claim 30, wherein said linking group is selected from the group consisting of a substituted or unsubstituted alkylene group or a substituted or unsubstituted group having at least two alkylene groups linked with each other by an oxygen atom to form a divalent group, substituted or unsubstituted phenylene group, —NHCO—$R^{14}$—CONH— group (wherein $R^{14}$ represents a substituted or unsubstituted alkylene or phenylene group), or —S—$R^{15}$—S— group (wherein $R^{15}$ represents a substituted or unsubstituted alkylene group).

32. A method as in claim 29, wherein X represents a group obtained by converting the monovalent group described in claim 3 to a divalent group.

33. A method as in claim 29, wherein said coupler is a polymer containing a monomer represented by formula (I) wherein $R^{11}$, $R^{12}$, $R^{13}$, or X represents an ethylenic unsaturated group having a linkage group selected from the group consisting of a substituted or unsubstituted alkylene group, a substituted or unsubstituted group having at least two aklylene groups linked with each other by an oxygen atom to form a divalent group, substituted or unsubstituted phenylene group, —NHCO—, —CONH—, —O—, and substituted and unsubstituted aralkylene groups, and groups formed by combination of two or more of these groups.

34. A method as in claim 18, wherein said polymer is one selected from the group consisting of (i) a polymer comprising at least one of monomers derived from the compounds represented by formula (I) and (ii) a copolymer comprising at least one of monomers derived from the compounds represented by formula (I) and a colorless ethylenic monomer which does not undergo coupling reaction with the oxidized form of an aromatic primary amine-developing agent.

35. A method as in claim 18, wherein the substituent(s) of said subtituted alkyl group is a group selected from the group consisting of a hydroxy group, halogen atom, —$SO_3M$, —COOM (wherein M represents H, an alkali metal atom, an alkaline earth metal atom, and $NH_4$), amino group, alkoxy group, alkylthio group, aryloxy group, arylthio group, sulfonamido group, alylamido group, and aldehyde group.

36. A method as in claim 18, wherein the substituent(s) of said substituted alkoxy group is a group consisting of an alkoxy group, phenyloxy group, halogen atom, and amino group.

37. A method as in claim 18, wherein said substituted aromatic group is a substituted phenyl group having a substituent selected from the group consisting of an alkyl group, alkoxy group, and halogen atom.

38. A method as in claim 18, wherein the substituents of said substituted alkylthio group is an alkoxy group.

39. A method as in claim 18, wherein said alkylene group has from 1 to 4 carbon atoms.

40. A method as in claim 18, wherein M represents a hydrogen ion, an alkali metal ion, an alkaline earth metal ion or an ammonium ion.

41. A method as in claim 18, wherein $R_2$ of formula (II) contains at least 6 carbon atoms.

42. A method as in claim 18, wherein said magenta coupler is incorporated in at least one of the light-sensitive silver halide emulsion layer and the layer(s) adjacent thereto.

43. A method as in claim 18, wherein said magenta coupler is incorporated in the light-sensitive material in an amount of from $1\times10^{-3}$ mol to 1 mol per mol of silver halide in said light-sensitive silver halide emulsion.

44. A method as in claim 18, wherein said compound of formula (II) is incorporated to the light-sensitive material in an amount of from 0.1 to 50 mol% of the amount of the magenta coupler.

45. A method as in claim 42, wherein said compound represented by formula (II) is incorporated in the light-sensitive silver halide emulsion layer containing the magenta coupler.

46. A method as in claim 18, wherein said compound represented by formula (II) is substantially non-diffusible in a hydrophilic colloid layer.

47. A method as in claim 18, wherein $R_2$ contains at least 10 carbon atoms.

48. A method as in claim 18, wherein $R_2$ contains at least 15 carbon atoms.

49. A method as in claim 18, wherein n in formula (II) is 0.

50. A method as in claim 41, wherein n in formula (II) is 0.

* * * * *